US007883188B2

(12) United States Patent
Scanlan et al.

(10) Patent No.: US 7,883,188 B2
(45) Date of Patent: Feb. 8, 2011

(54) INKJET CARTRIDGE REFILLING SYSTEM

(76) Inventors: David Scanlan, 2 Thornhill Road, Barnham Ipswich, Suffolk (GB) IP6 0BJ; Alan Hughes, Camino Enrique Alhaurin, 29120 Malaga (ES)

( * ) Notice: Subject to any disclaimer, the term of this patent is extended or adjusted under 35 U.S.C. 154(b) by 1054 days.

(21) Appl. No.: 11/450,116

(22) Filed: Jun. 9, 2006

(65) Prior Publication Data

US 2007/0285481 A1 Dec. 13, 2007

(51) Int. Cl.
*B41J 2/175* (2006.01)

(52) U.S. Cl. ..... 347/85

(58) Field of Classification Search ..... 347/7, 347/19, 85; 141/2, 9, 18, 94, 100, 104
See application file for complete search history.

(56) References Cited

U.S. PATENT DOCUMENTS 3,930,258 A * 12/1975 Dick et al. ..... 347/7
6,729,360 B2 * 5/2004 Sesek et al. ..... 141/2
7,089,973 B2 * 8/2006 Nicodem et al. ..... 141/18
7,207,667 B2 * 4/2007 Ansier et al. ..... 347/85
7,344,215 B2 * 3/2008 Cutler et al. ..... 347/7
2004/0040614 A1 3/2004 Sesek et al.
2004/0263589 A1 12/2004 Ansier et al.
2005/0034777 A1 2/2005 Nicodem et al.
2006/0109320 A1 5/2006 Cutler et al.
2007/0176981 A1 8/2007 Shahar

FOREIGN PATENT DOCUMENTS

EP 1661710 5/2006
WO WO 2004/091920 10/2004

OTHER PUBLICATIONS

International Search Report and Written Opinion for PCT/GB2007/002144 dated Sep. 24, 2007.

* cited by examiner

*Primary Examiner*—Anh T. N. Vo
(74) *Attorney, Agent, or Firm*—McDermott Will & Emery LLP

(57) ABSTRACT

A computer-controlled, semi-automatic, refill system for inkjet cartridges includes a touch screen and audio system for providing on-screen graphic and auditory instructions. The system also includes a plurality of exhausting units, a plurality of refilling units, a weighing unit and a plurality of test printers. The system is adapted to refill a plurality of black, color and color photo inkjet cartridge models from a plurality of manufacturers.

8 Claims, 24 Drawing Sheets

INKJET CARTRIDGE REFILLING SYSTEM

TECHNICAL FIELD

The present subject-matter generally relates to an inkjet cartridge refilling system. More specifically, the present subject-matter relates to a computer-controlled, semi-automatic, refill system for inkjet cartridges.

BACKGROUND OF THE INVENTION

Inkjet cartridges are commonly used in printers connected to personal computers. In many cases, the cartridge runs out of ink long before the cartridge structure reaches the end of its lifespan. In such cases, it is beneficial for the consumer and the environment to recycle the spent cartridge by testing the electronic components and refilling the ink chambers within the cartridge. Efficiently and effectively refilling inkjet cartridges requires specialized knowledge, tools and supplies to which the typical consumer does not have access. Consumer oriented stores have not been able to provide inkjet cartridge refilling services due to the limited training and experience of their employees and the lack of an appropriate in-store inkjet refilling system. Therefore, a need exists for a computer-controlled, semi-automatic, refill system for inkjet cartridges.

SUMMARY

The present subject-matter provides a computer-controlled, semi-automatic, refill system for inkjet cartridges. Various different components may be included in the system and/or used in a variety of combinations. The system includes a touch screen and audio system for providing on-screen graphic and voice instructions for an operator to exhaust, clean, refill and test inkjet cartridges. The system includes a kiosk with storage space for ink, tools, packaging materials, fresh water and waste water and may further include printers to provide UPC barcodes or sales tickets. The system is capable of refilling a wide variety of black ink, color and photo inkjet cartridges.

The system includes test printers for testing various inkjet cartridge models. The operator is directed to use the proper test printer to test for electric faults before refilling a cartridge. Each test printer includes a yoke for accepting the cartridge to be tested. The test printer provides confirmation of the integrity of the cartridge, using lights to signal the operator, green for good and red for bad.

The system also includes exhausting units and/or a centrifuge system for emptying any residual ink from the cartridge to be refilled. Each exhausting unit is designed to accept a particular model or family of inkjet cartridge and exhausts any residual ink into a waste ink collector. The system directs the operator to the proper exhausting unit for the particular inkjet cartridge. The operator is then directed to a weighing station which is used to ensure the cartridge is completely empty before the refilling process is started. An electronic scale connected to the computer is used to compare the weight of the exhausted cartridge to saved values corresponding to the particular model cartridge being weighed to ensure no residual ink remains in the cartridge after the exhausting process. If the measured weight does not correspond to the expected weight of the exhausted cartridge, the system directs the operator to an atomizer or steamer clearing unit, which sprays distilled water onto the cartridge printing head to remove any residual ink from the printing head.

After the exhausting process is complete, the operator is directed to seal the cartridge head using a sealing clip or a silicon pad. Sealing the head prevents ink from leaking through the printing head during the refilling process. After the printing head is sealed, the operator is directed to place the cartridge in a holding block and attach an adapter to the cartridge to assist inserting the refilling needles into the proper positions.

The system further includes a plurality of refilling units for refilling the inkjet cartridges. In one example, there is a universal black refilling chamber, two separate three-color refilling chambers (each used for different brand cartridges) and a photo cartridge refilling chamber. The system directs the operator to use the proper refilling chamber by lighting an indicator above the chamber to be used. The operator then places the cartridge in the proper chamber, inserts the refilling needles into the correct color chambers and closes the refilling unit.

The refilling unit evacuates the air from the chamber, including the cartridge chambers to be refilled before delivering the ink refill. Filling the cartridge in a vacuum prevents air bubbles from contaminating the ink chambers. Each of the refilling units may operate at a different pressure.

After the refilling process is complete, the operator is directed to reweigh the cartridge to ensure the cartridge weight falls between the expected range of a refilled cartridge. An acceptable weight range is provided to account for variances within the same model of cartridge due to the different materials that may be used based on the country of origin of the cartridge.

The operator is then directed to unseal the cartridge head, place the cartridge in the proper test printer and run a test print to determine the print quality of the refilled cartridge. If the cartridge passes the test print, the operator is directed to reseal the cartridge head, package the cartridge and print a UPC label for purchasing the refilled cartridge.

The system includes sales control software, which provides daily, weekly, monthly and yearly automatic cartridge sales and inventory reporting logs. Internet connection of the system provides remote sales and inventory reporting and service diagnostics, as well as allows for online updating and upgrading of the system software.

The system also offers an advanced user setting, whereby the user is directed to electrically test the cartridge, start the refill process and test print, but the operator is not given detailed directions at each step of the processes described above.

An advantage of the inkjet cartridge refilling system is users may clean, test and refill used inkjet cartridges in a timely and cost effective manner in an in-store environment.

Another advantage of the inkjet cartridge refilling system is the onboard operational graphic and voice instructions allow minimally trained operators to effectively operate the system.

A further advantage of the inkjet cartridge refilling system is the computer controlled refilling unit and ink delivery allows uncontaminated and mess free refilling of the cartridges.

Yet another advantage of the inkjet cartridge refilling system is the network connectivity of the system enables online inventory and sales reporting, as well as remote service diagnostics.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

DETAILED DESCRIPTION

Figure 1:
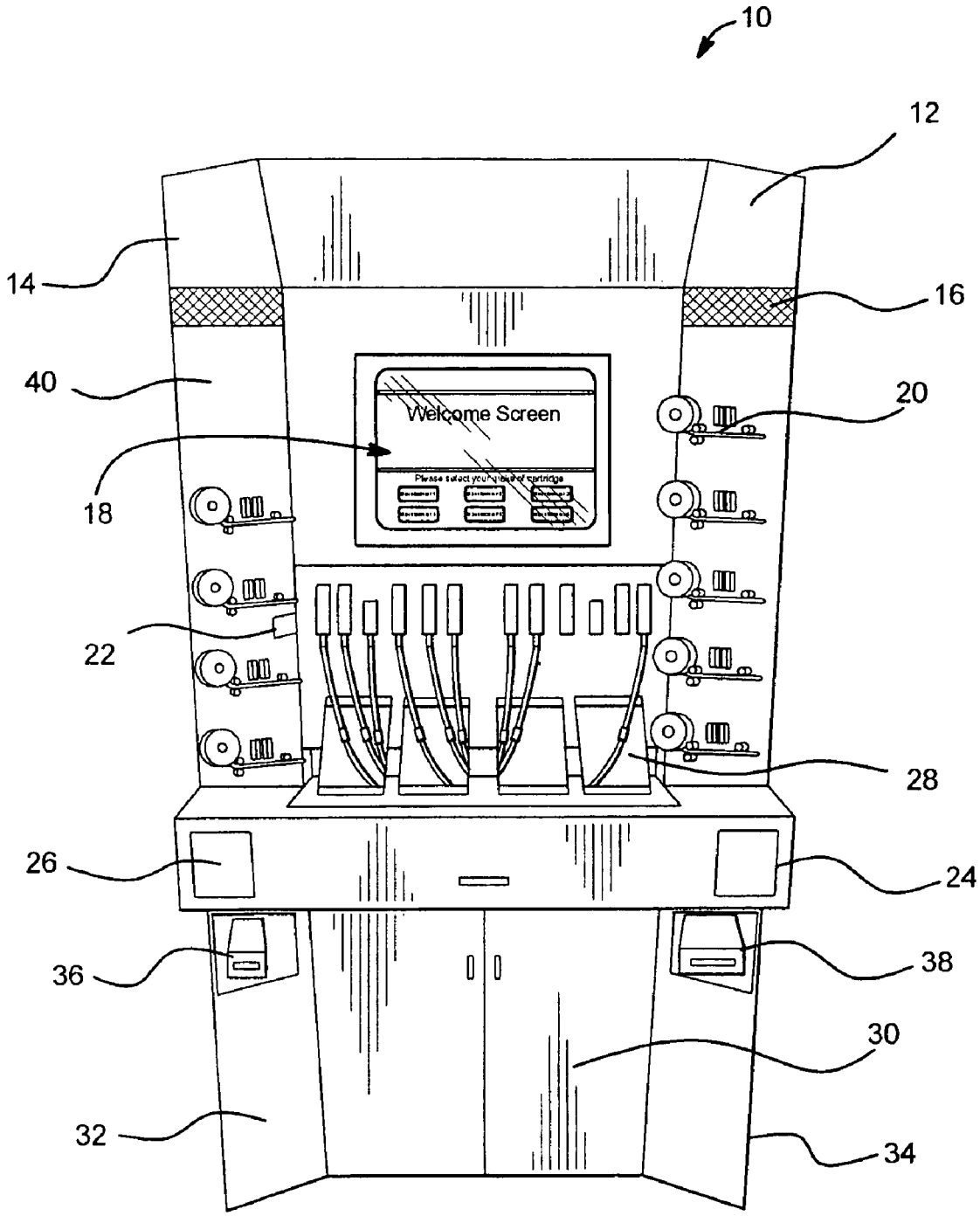
FIG. 1 is a front view of a inkjet cartridge refilling system.

FIG. 1 illustrates one example of an inkjet cartridge refilling system 10. As shown in FIG. 1, the system 10 includes a housing 12 including a light box 14, an audio system 16, a video touch screen 18, a plurality of test printers 20, a plurality of exhausting units 22, a weighing station 24, an clearing unit 26, a plurality of vacuum refilling chambers 28, ink storage 30, fresh water storage 32, waste water storage 34, a bar code printer 36 and a sales ticket printer 38. In addition, the system 10 shown in FIG. 1 includes spare test printers 40 and a compartment for storage of additional materials 42. As shown in FIG. 1, the system 10 is a stand-alone kiosk for in-store placement and measures approximately 97 inches high, 46 inches wide and 39 inches deep. However, it is contemplated that the system may be employed in any type of stand-alone, desktop, or other size and configuration. Other systems may include different combinations of the components described herein, or additional components. In addition, the components may be used in a variety of combinations.

By incorporating a plurality of test printers 20, exhaust units 22 and vacuum refilling chambers 28, the system 10 is adapted to refill various models of inkjet cartridges from various inkjet manufactures, including black ink, color and photo inkjet cartridges.

The audio system 16 and touch screen 18 shown in FIG. 1 provide on-screen graphic and auditory instructions for an operator to exhaust, clean, refill and test inkjet cartridges. An example of the instructions that may be provided by the system 10 is described in detail below with respect to FIGS. 2-18. In the system 10 shown in FIG. 1, it is contemplated that the auditory instructions supplement and complement the on-screen instructions provided by the image based interface, for example, as shown in FIG. 1, the touch screen 18. As shown, at each step of the operation, the on-screen instructions displayed on the touch screen 18 enable the operator to move forward or backward through the instructions, as well as return directly home to the main menu. It is understood that any number of other combinations of the instructions may be provided in addition to, or in the alternative, using the system 10.

The graphic instructions provided by the image based interface, for example the touch screen 18 in the system 10 shown in FIG. 1, incorporates photographic images, such as, for example, JPEG based file format graphics. Alternatively, other photographic image file formats may be employed in the system 10, such as, for example, JFIF, Exif, JNG, TIFF, PNG, GIF file formats and any other format suitable for photographic images. It is contemplated that the touch screen 18 shown in FIG. 1 is merely one example of a image based interface that may be employed in the system 10.

Figure 2:
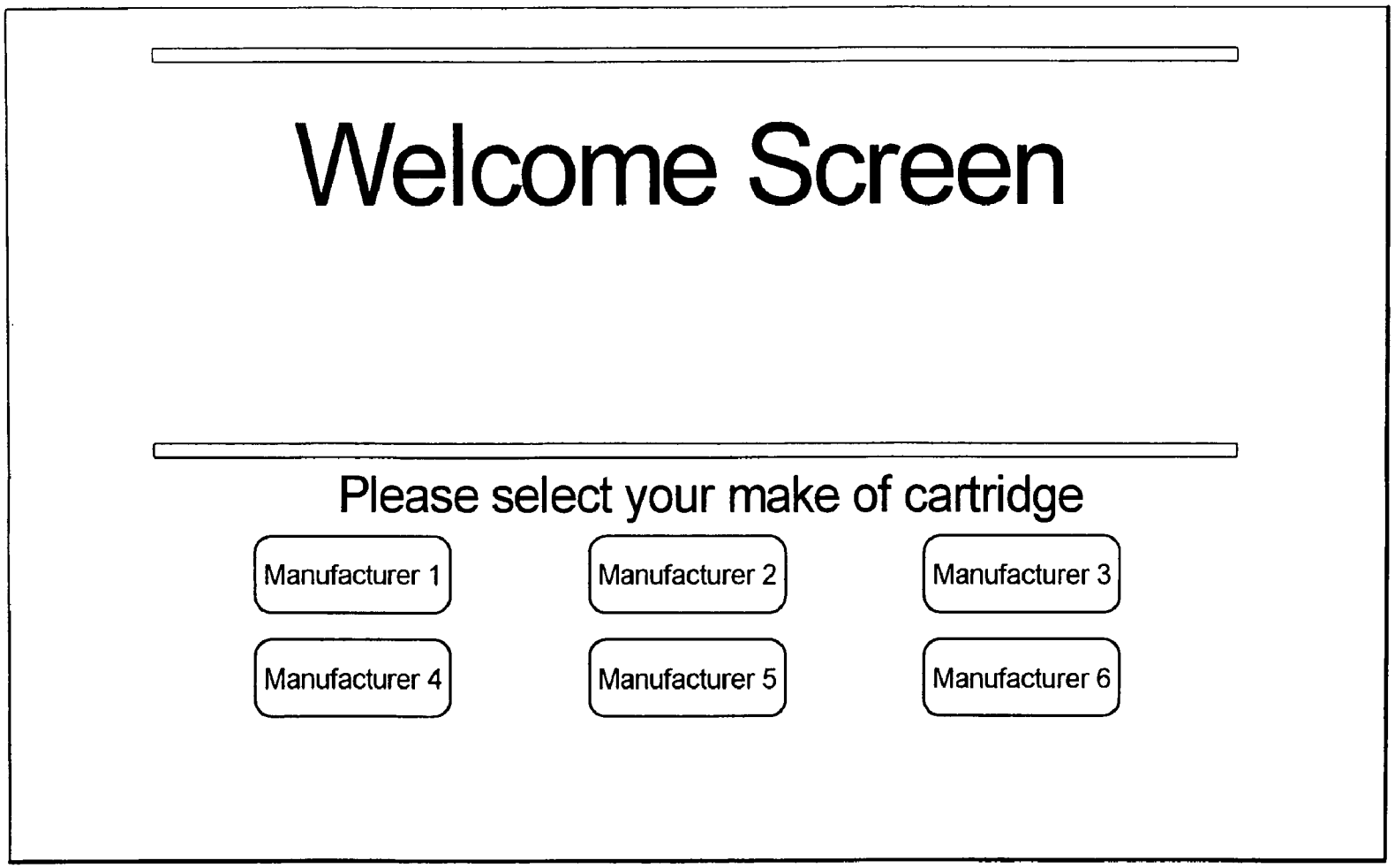
FIG. 2 is welcome screen which may be displayed on the video screen shown in FIG. 1.
Figure 3:
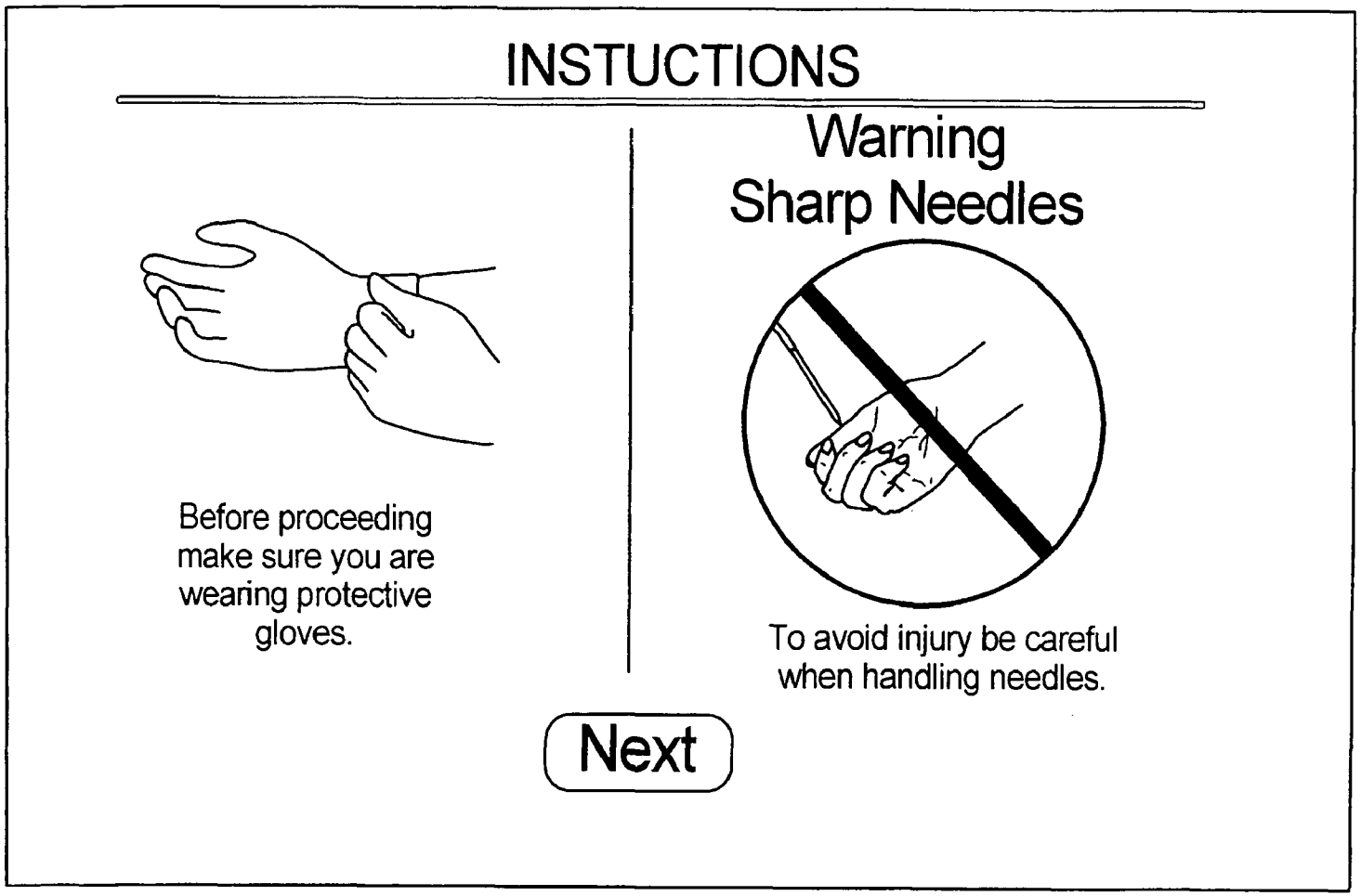
FIG. 3 is an instruction screen which may be displayed on the video screen shown in FIG. 1.
Figure 4:
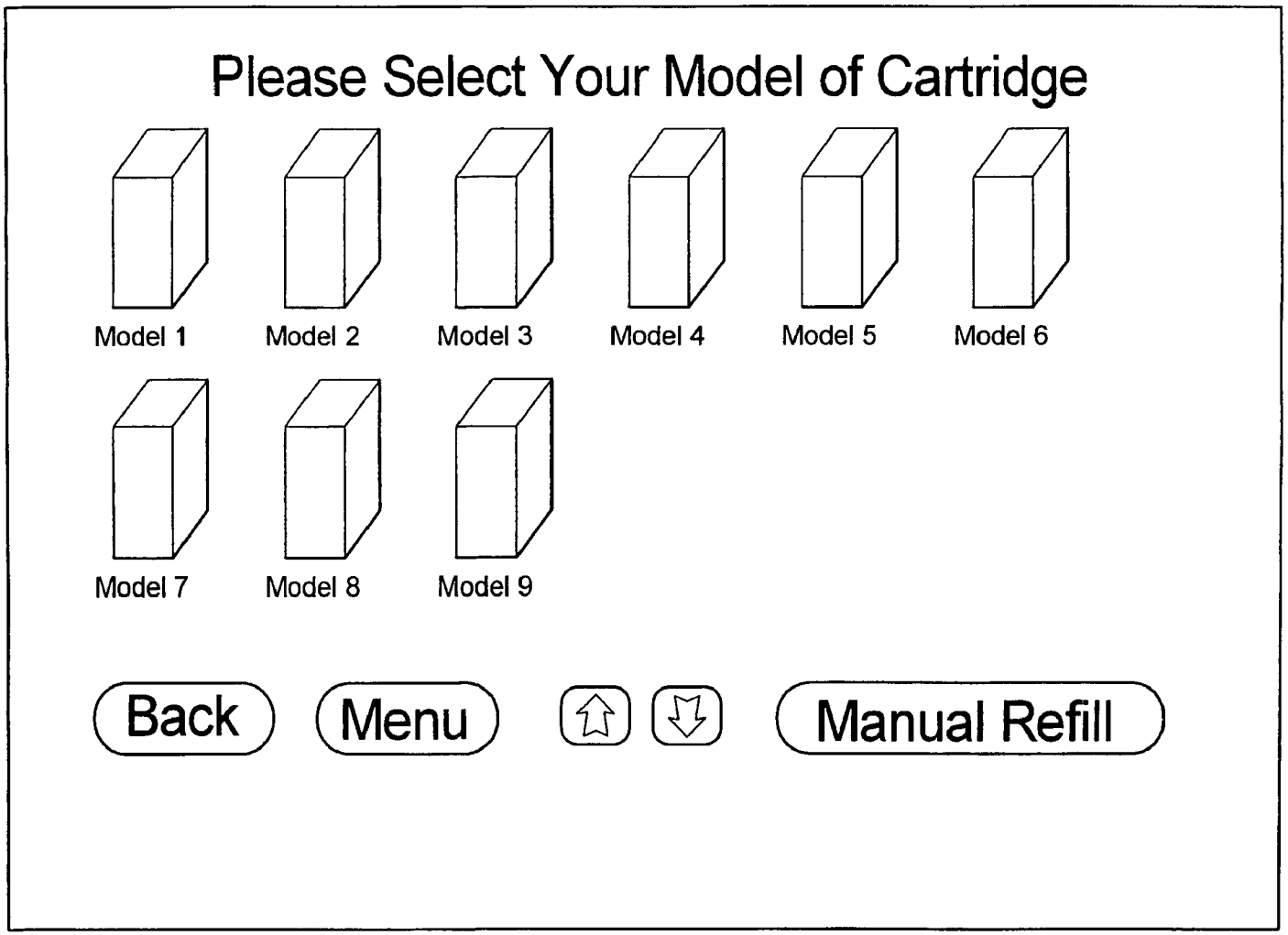
FIG. 4 is a cartridge selection screen which may be displayed on the video screen shown in FIG. 1.

As shown in FIG. 2, the instructions may include the display of a welcome screen to prompt the operator to select the brand of inkjet cartridge to be refilled. The operator may then be instructed to put on protective gloves and reminded to be careful with the needles used in the refilling process as shown in FIG. 3. Next, the operator may be prompted to select the model of the cartridge to be refilled. As shown in FIG. 4, the prompting may include a visual representation of the various cartridge models to enable an operator to visually identify the model to be refilled.

Figure 5:
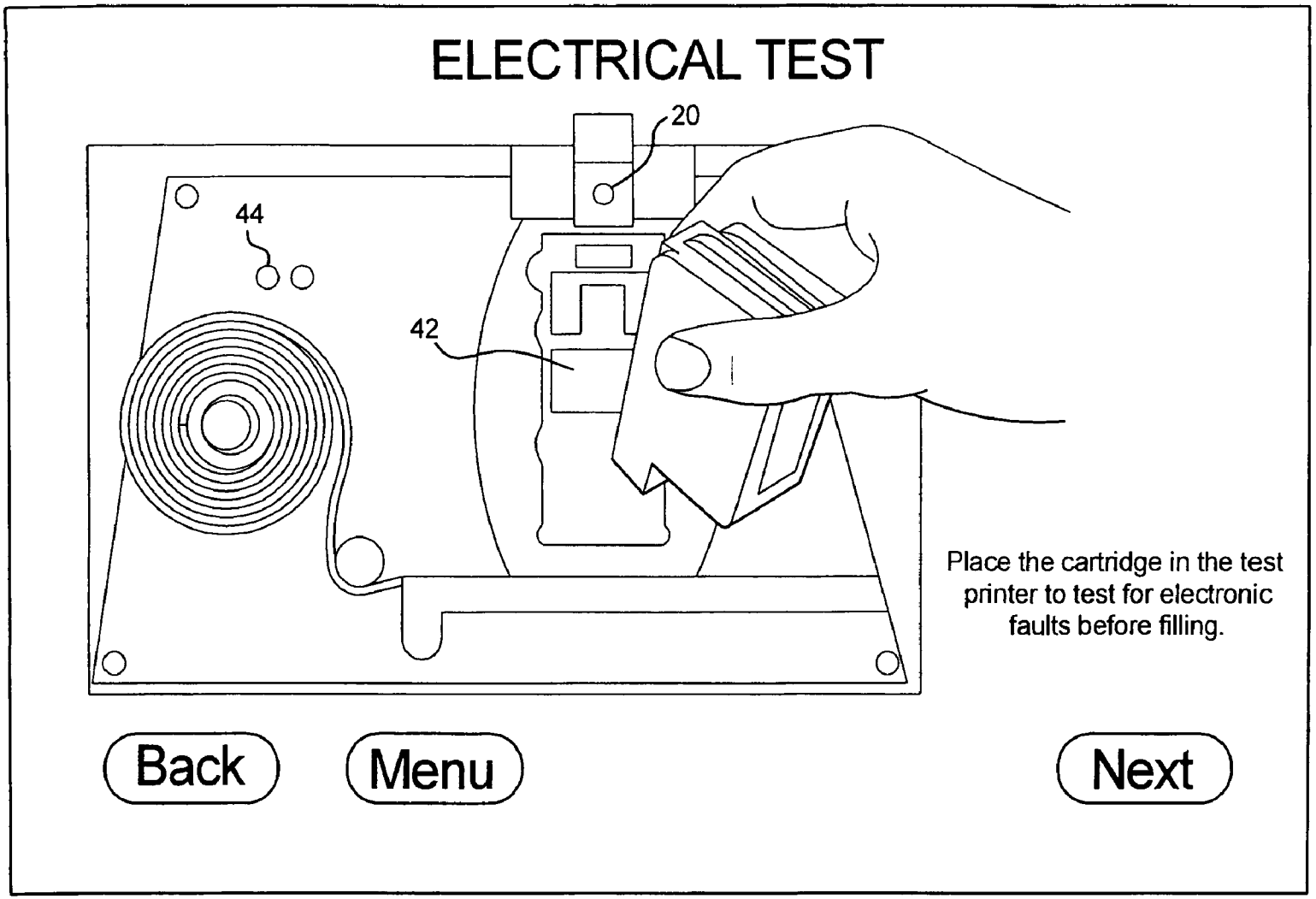
FIG. 5 is an electrical test instruction screen which may be displayed on the video screen shown in FIG. 1.

FIG. 5 illustrates an example of an electrical test instruction display. As shown in FIG. 5, the touch screen 18 directs the operator to place the cartridge in the appropriate test printer 20 to test for electronic faults before refilling the cartridge. In the embodiment shown in FIG. 1, the system 10 includes nine unique test printers 20*a-i* for testing various cartridge models or ranges of cartridge models. For example, a subset of the test printers 20 may be adapted to test cartridges from a certain manufacturer. Each of the test printers 20 within the subset for a given manufacturer may be adapted to test a series of cartridges offered by the manufacturer.

As shown in FIG. 5, in the system 10 shown in FIG. 1, each of the test printers 20 includes a yoke 42 for accepting a cartridge to be tested. Each yoke 42 may be adapted for use with a particular cartridge model or range of cartridge models. The test printers 20 in the system 10 shown in FIG. 1, include electronic testing units for determining whether there are any electronic faults in the cartridge. However, it is contemplated that the electronic testing units may be a standalone unit separate from the test printers 20, or may be incorporated into another unit in the system 10.

In the example shown in FIG. 5, the test printers 20 include light indicators 44 to signal whether the electronics in the cartridge are faulty. The indicators shown in FIG. 5 signal green for good electronics and red for faulty electronics. In another example, the touch screen 18 or audio system 16 signals to the operator whether the electronics in the cartridge are faulty.

Certain brands and models of cartridges may include serial numbers, which communicate information to printers. For example, certain cartridges may include a serial number that identify the cartridge as empty. The test printers may be designed to ensure the refilled cartridges will not be improperly identified as empty by a printer after the refilling process is complete. For example, a serial number may be stored in a cartridge by a line of resistors. By altering the configuration of the resistors, for example, by blowing out one or more of the resistors, the serial number may be altered.

Figure 6:
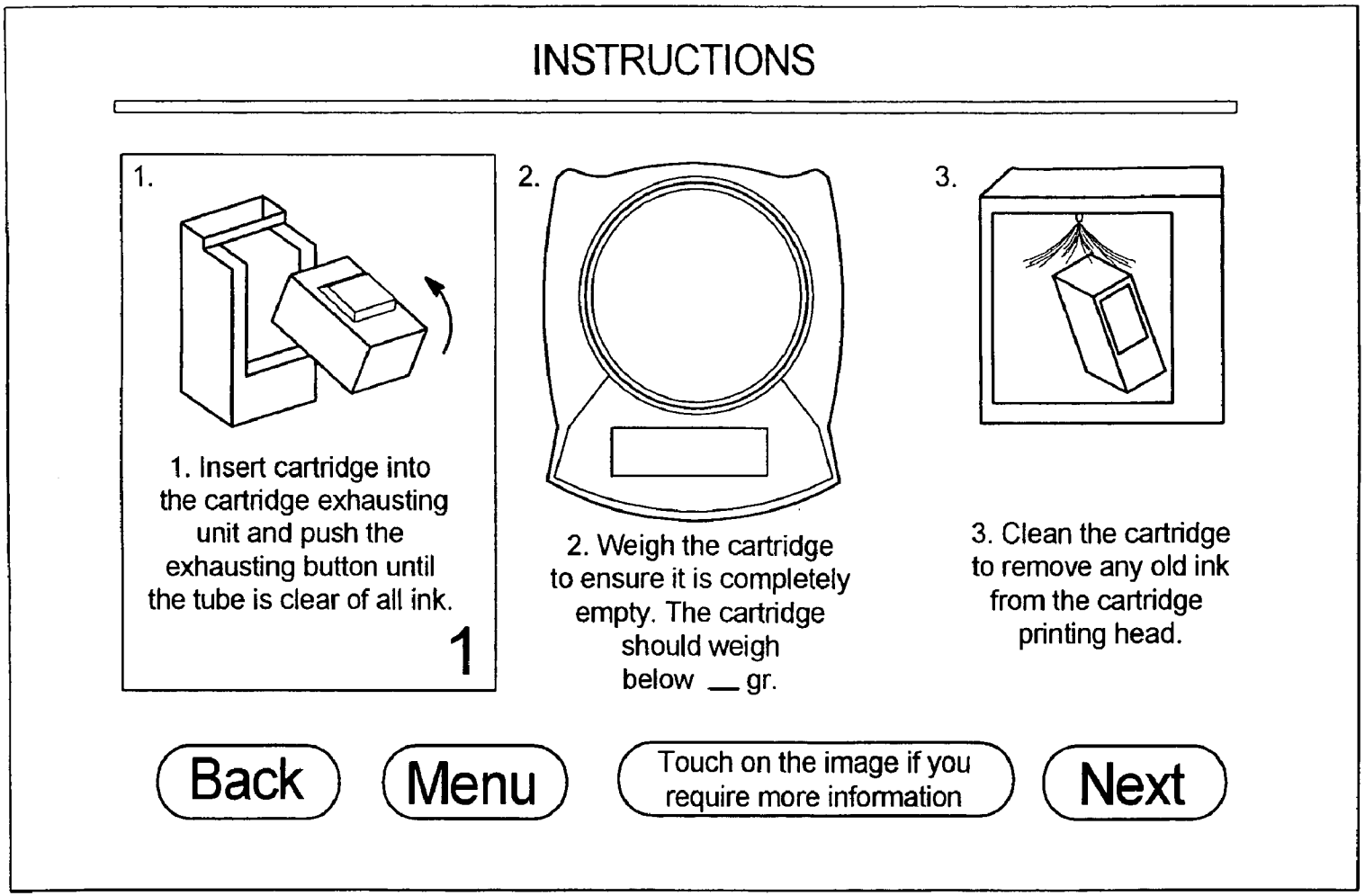
FIG. 6 is an exhausting unit instruction screen which may be displayed on the video screen shown in FIG. 1.

After the cartridge has been tested for electrical faults, the system 10 may instruct the operator to exhaust the cartridge using one of the exhausting units 22, as shown in FIG. 6. In the embodiment shown in FIG. 1, the system 10 includes ten unique exhausting units 22 for exhausting various cartridge models or ranges of cartridge models, including a spare exhausting unit 22 and a manual exhausting unit 22. It is contemplated that any number of exhausting units 22 may be used.

The exhausting units 22 are used to clear any residual ink from the cartridge to be refilled. The exhausted ink is stored in the waste ink collector in the ink storage 30. As shown in FIG. 6, the system directs the operator to the proper exhausting unit 22 for the particular inkjet cartridge.

Figure 7:
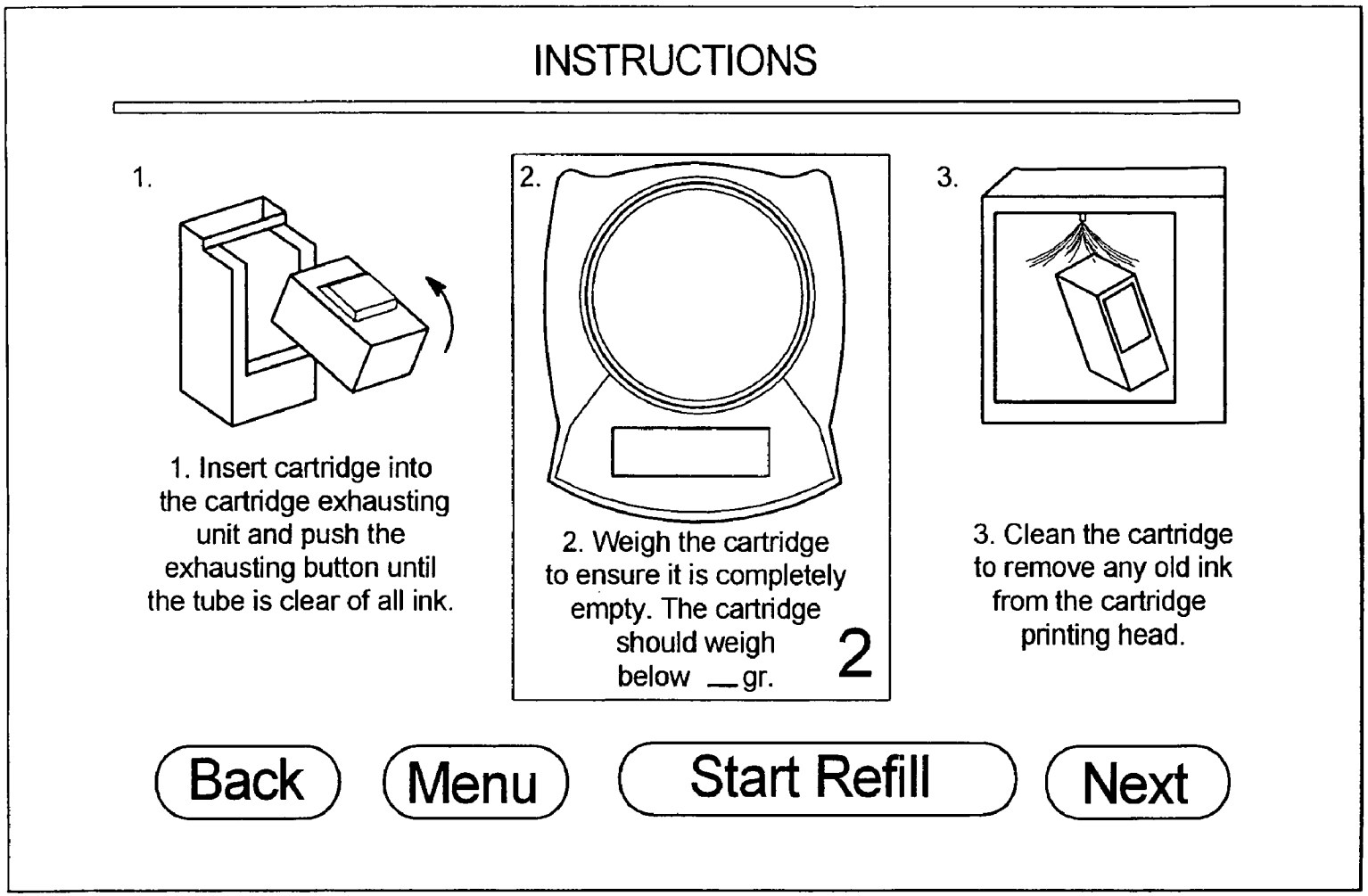
FIG. 7 is a weighing station instruction screen which may be displayed on the video screen shown in FIG. 1.
Figure 8:
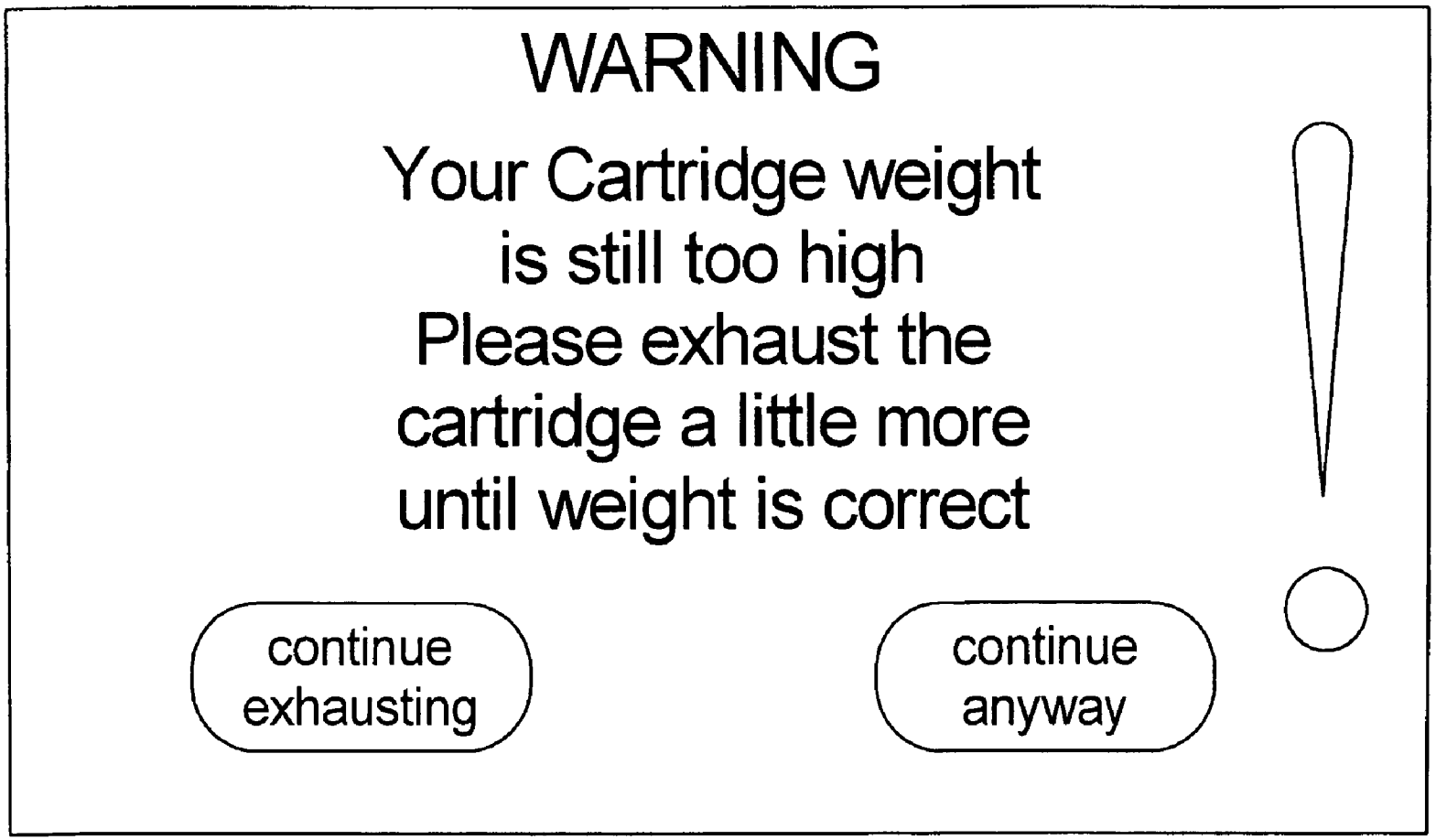
FIG. 8 is an exhausting unit warning screen which may be displayed on the video screen shown in FIG. 1.

As shown in FIG. 7, the operator is then directed to the weighing station 24. The weighing station 24 is used to ensure the cartridge is completely empty before the refilling process is started. The weighing station 24 shown in FIG. 1 includes a computer-controlled electronic scale 62. The scale 62 compares the weight of the exhausted cartridge to saved values corresponding to the particular model cartridge being weighed to ensure no residual ink remains in the cartridge after the exhausting process. If the measured weight does not correspond to the expected weight of the exhausted cartridge, the system 10 directs the operator to again exhaust the cartridge until the weight is correct, as shown in FIG. 8.

Alternatively, the exhausting units 22 may automatically weigh and empty the cartridge of any residual ink. For example, one or more of the exhausting units 22 may include a load cell sensor fitted behind the exhaust unit. Before the cartridge is placed into the exhaust unit, the load cell sensor reading is zeroed. When the cartridge is placed on the exhausting unit 22, the cartridge is weighed and the exhausting pump is turned on to empty the cartridge of any residual ink. The computer continues to monitor the load cell every five seconds until the optimum weight is reached, at which point the pump is turned off and the operator is alerted to remove the exhausted cartridge.

As an alternative to the exhausting units 22 described above, a centrifuge unit may be utilized to empty a cartridge of any residual ink. For example, the system 10 may include an electric motor driven centrifuge unit. A cartridge may be placed into a holding block clipped into an aluminum plate at the bottom of the centrifuge unit. The centrifuge may include an electric solenoid to lock the unit closed when in operation and red and green lights to indicate when it is safe to open the unit and access the cartridge. The centrifuge may be operated by the system 10 or by an operator using manual controls, for example, a switch, provided on the housing 12.

Figure 9:
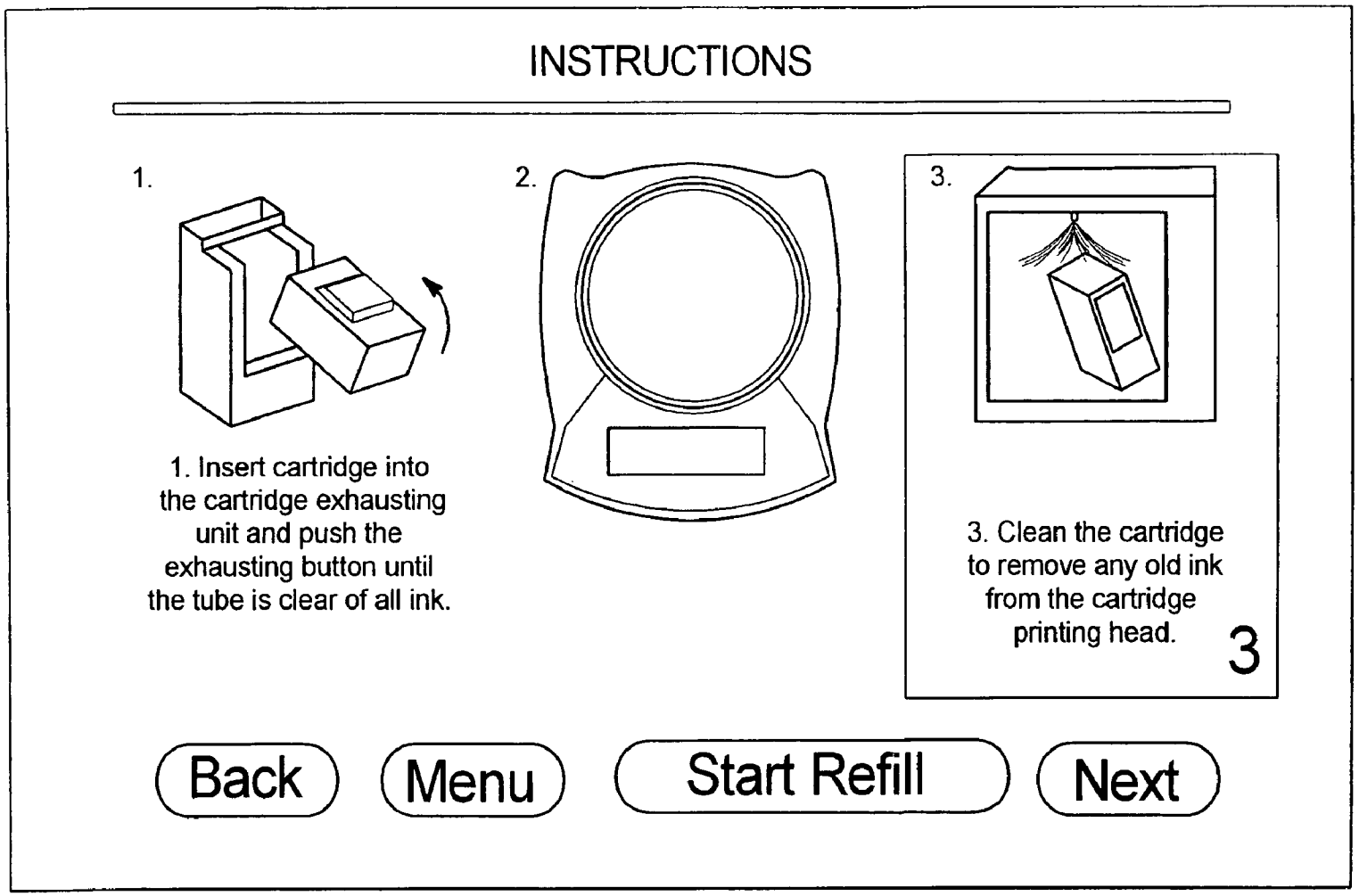
FIG. 9 is a clearing unit instruction screen which may be displayed on the video screen shown in FIG. 1.

After the cartridge has been exhausted to within the proper weight range, the operator is directed to the clearing unit 26, as shown in FIG. 9. The clearing unit 26 shown in FIG. 1 is an atomizer clearing unit that sprays distilled water and a cleaning agent onto the cartridge printing head to remove any remaining old ink from the printing head. The clearing unit 26 uses the fresh water stored in the fresh water storage 32 and collects the used water in the waste water storage 34. It is understood that other clearing units 26 may be employed with the system 10. For example, the system 10 may include a steam cleaning unit wherein the cartridge head is cleaned using steam.

The steam cleaning unit may include a steam cleaning chamber with a locking chamber door. The operator may load the cartridge into the chamber and close the door, which is locked using an electric solenoid. A small amount of water is then pumped into the chamber and converted into steam to clean the printing head of any residual ink. Once the printing head has been cleaned and the steam has dissipated, the chamber door automatically unlocks and the operator may be signaled to remove the cartridge, for example, using a red light to signal when the chamber door is locked.

Figure 10:
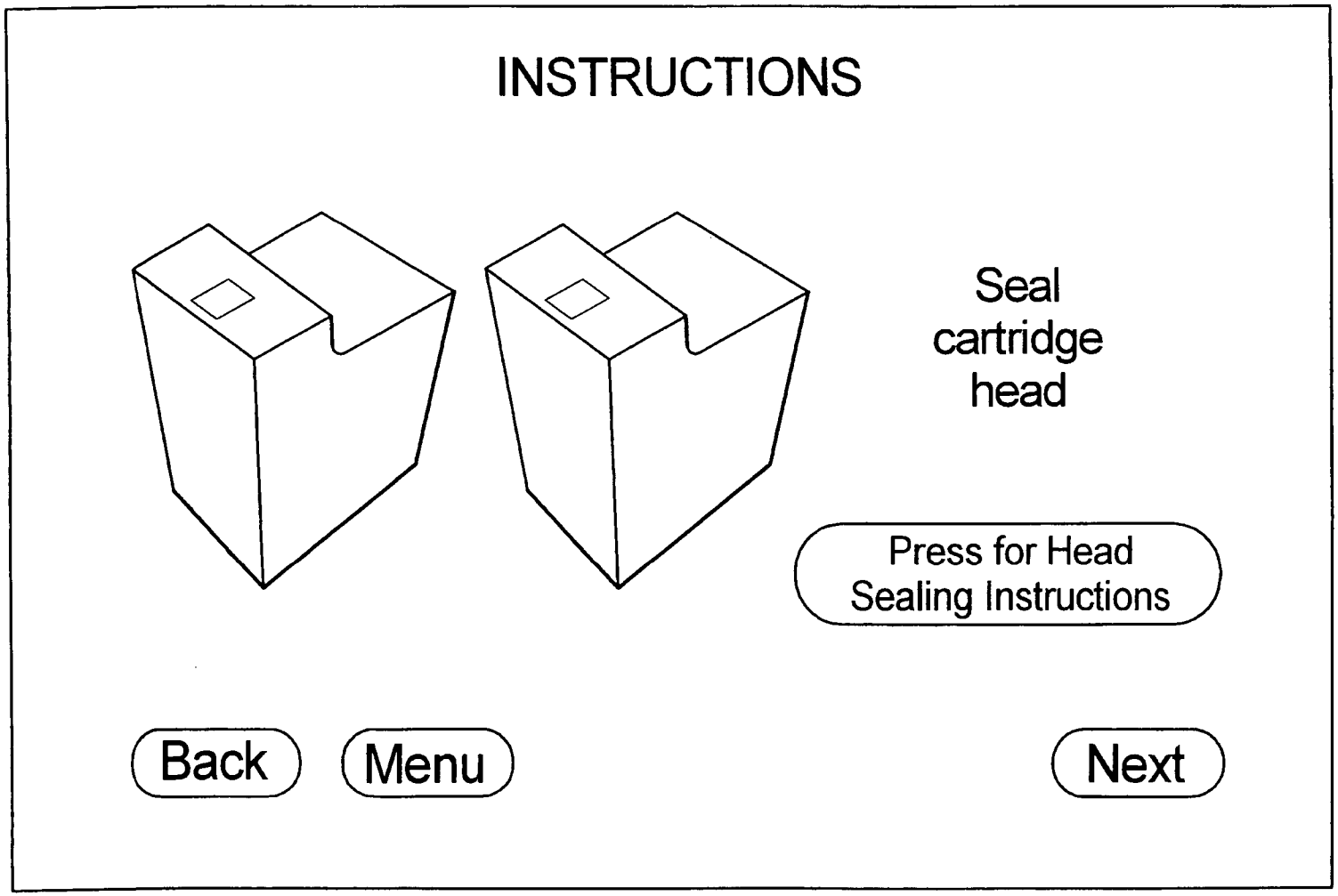
FIG. 10 is an instruction screen for sealing the cartridge head which may be displayed on the video screen shown in FIG. 1.

After the exhausting, weighing and clearing processes are complete, the operator is directed to seal the cartridge's printing head before refilling the ink chamber or chambers, as shown in FIG. 10. Sealing the printing head prevents ink from leaking through the head during the refilling process. In the example shown in FIG. 10, the cartridge head is sealed using a silicon pad. However, other methods of sealing the cartridge's printing head may be employed, for example, using a sealing clip.

Figure 11:
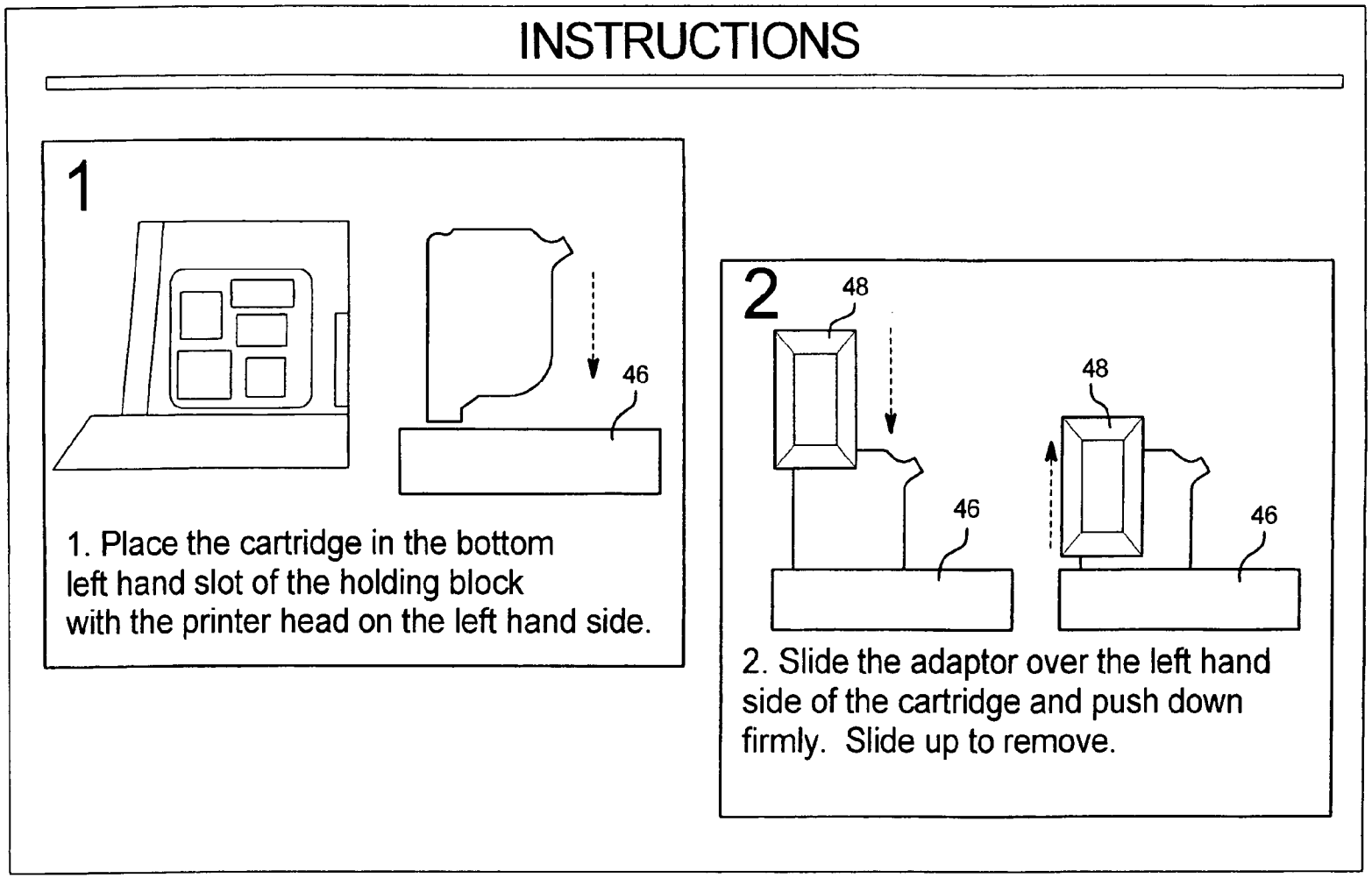
FIG. 11 is an instruction screen for mating an adapter to the cartridge which may be displayed on the video screen shown in FIG. 1.

After the cartridge's printing head is sealed, the operator may be directed to place the cartridge in a holding block 46 and attach an adapter 48 to the cartridge to assist inserting the refilling needles into the proper positions, as shown in FIG. 11. The adapter 48 may be required for certain models of cartridges and not others. Moreover, the system 10 may provide a plurality of adapters corresponding to a plurality of models of cartridges to be refilled.

Figure 12:
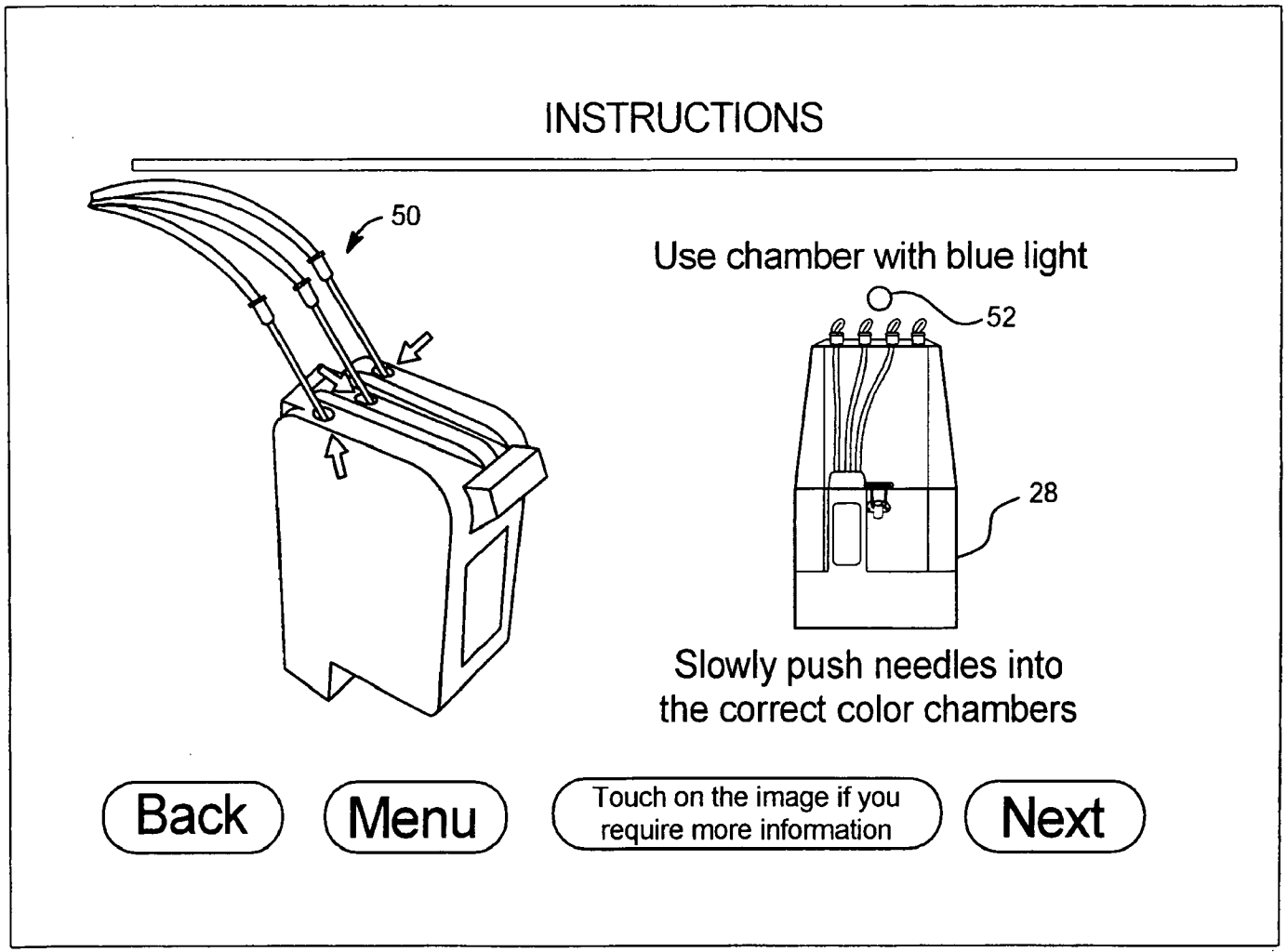
FIG. 12 is an instruction screen for inserting the refilling needles which may be displayed on the video screen shown in FIG. 1.

After the cartridge's printing head has been sealed and any required adapter 48 has been properly fitted, the operator may be directed to insert the one or more refilling needles 50 into the one or more ink chambers in the cartridge, as shown in FIG. 12. For example, a black ink inkjet cartridge may only have a single chamber to be filled with black ink, while color or photo ink inkjet cartridges may include a plurality of ink chambers corresponding to the number of ink colors. In the system 10 shown in FIG. 1, there are separate refilling units 28, and corresponding refilling needles 50, to be used with black ink cartridges, color ink cartridges from a first subset of manufactures, color ink cartridges from another subset of manufacturers and photo inkjet cartridges. Alternatively, there may be any number of refilling units 28 and sets of refilling needles 50. For example, there may be separate refilling units 28 for refilling cartridges under various amounts of vacuum pressure.

As shown in FIG. 12, the system 10 shown in FIG. 1 includes signal lights to indicate which of the refilling units 28 to use for a given cartridge. In the system shown in FIGS. 1 and 12, a blue light 52 indicates to the operator which of the refilling units 28 to use. Other signals may be used, for example, the touch screen 18 may indicate which refilling unit 28 to use. The refilling units 28 may, for example, be adapted to refill different types of cartridges and/or provide different types of ink and/or operate at different pressures. For example, the refilling units 28 may refill cartridges under full or partial vacuum.

Figure 13:
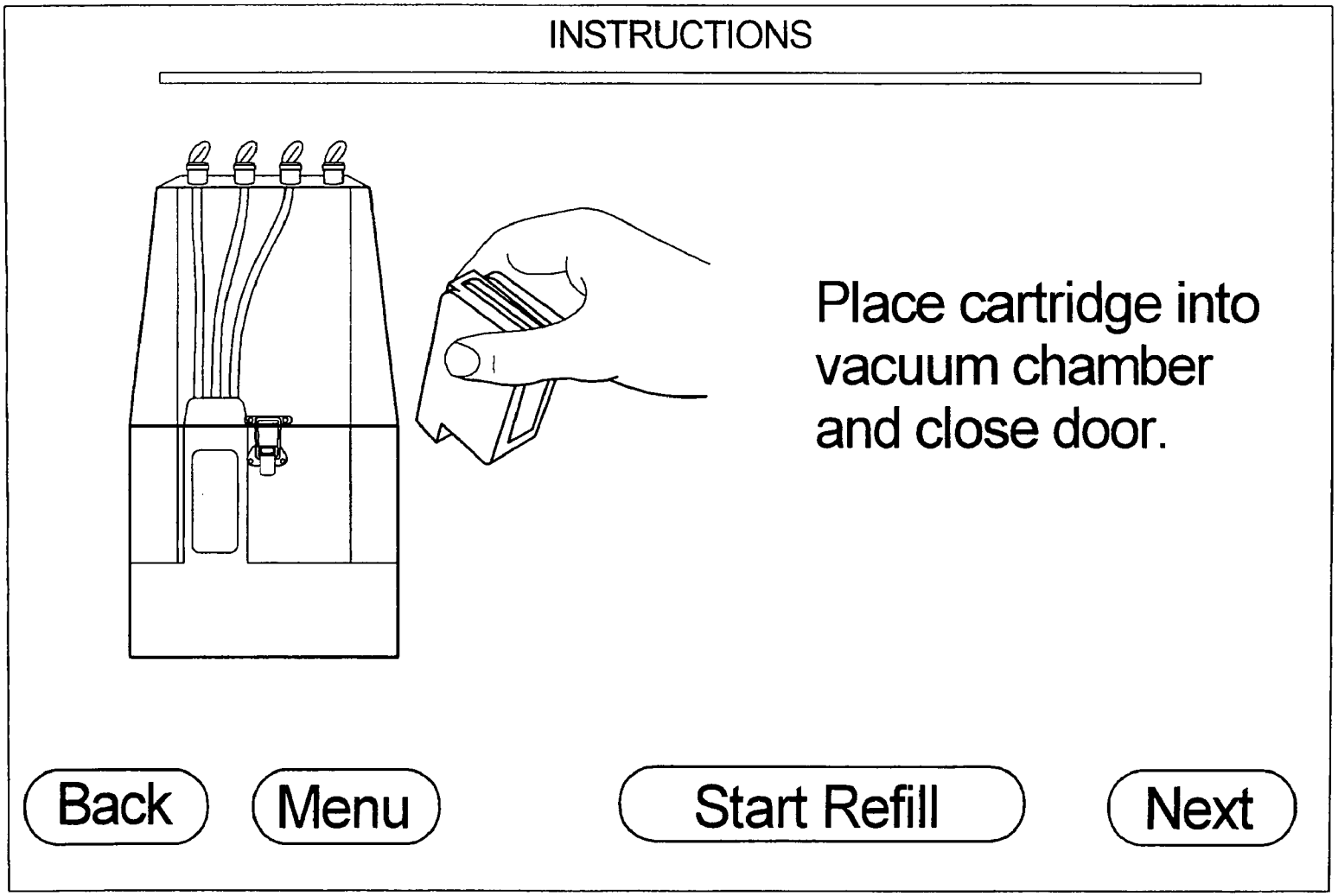
FIG. 13 is an instruction screen for operating the refilling units which may be displayed on the video screen shown in FIG. 1.
Figure 14:
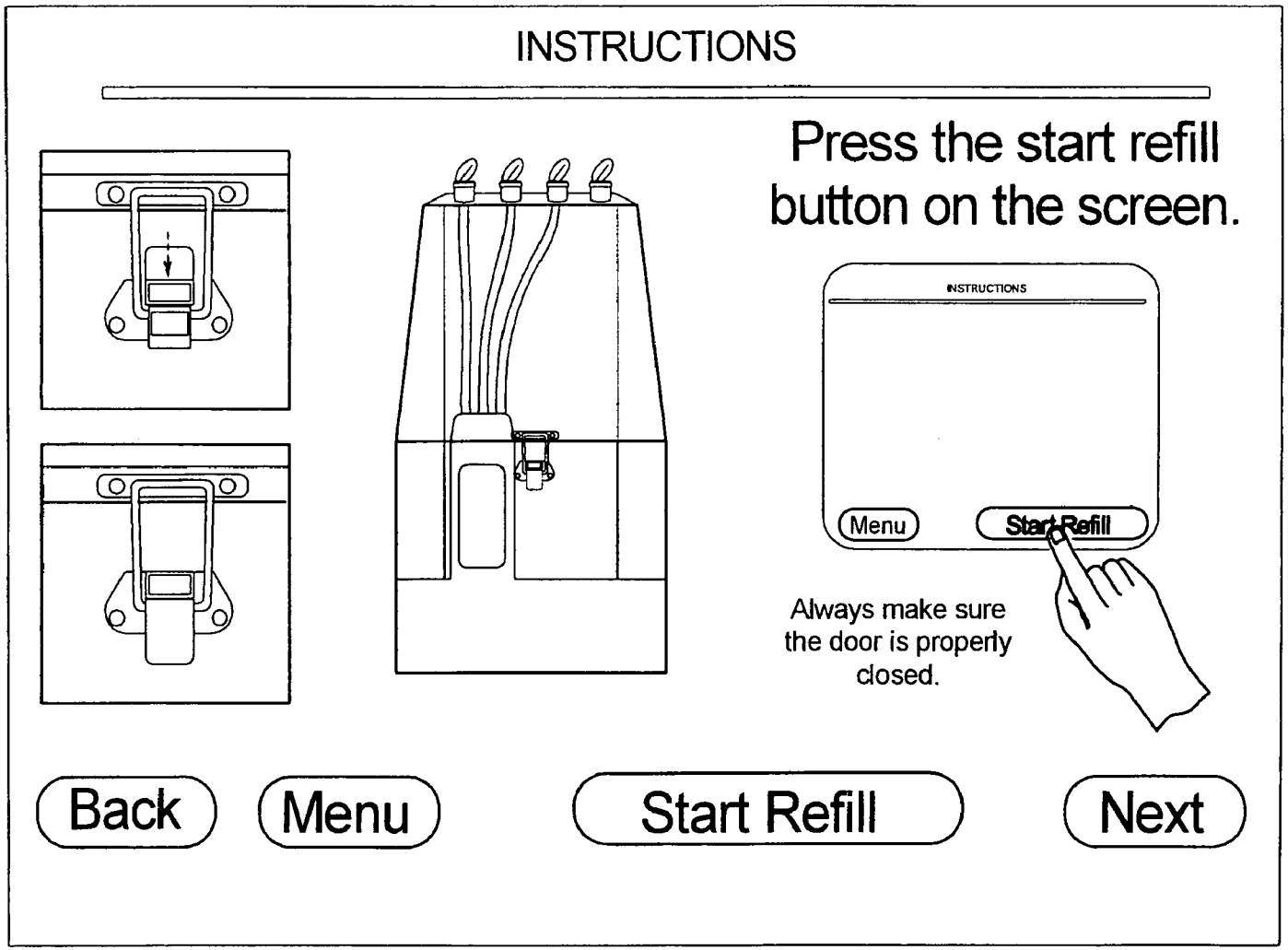
FIG. 14 is another instruction screen for operating the refilling units which may be displayed on the video screen shown in FIG. 1.

As shown in FIG. 13, the operator is then instructed to place the cartridge into the appropriate refilling unit 28 and close the refilling unit door. As shown in FIG. 14, after the refilling unit 28 is sealed, the operator is instructed to start the refilling operation. The refilling operation may include the step of evacuating all or substantially all of the air from the refilling unit 28, including the cartridge chambers to be refilled, before delivering the ink refill. Filling the cartridge in a vacuum prevents air bubbles from contaminating the ink chambers.

Figure 15:
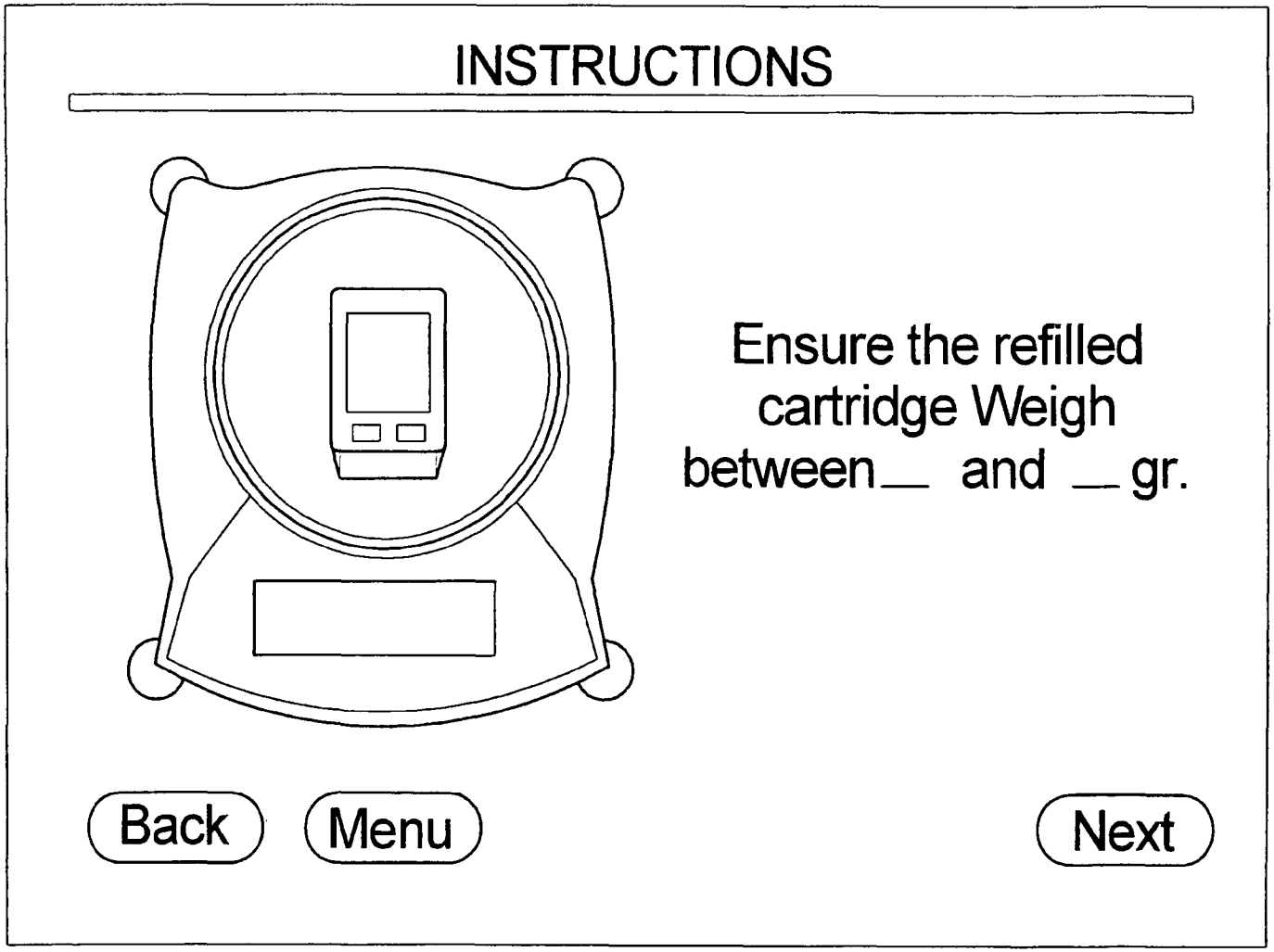
FIG. 15 is an instruction screen for weighing the refilled cartridge which may be displayed on the video screen shown in FIG. 1.

After the refilling process is complete, the operator is directed to reweigh the cartridge at the weighing station 24 to ensure the cartridge weight falls between the expected range of a refilled cartridge, as shown in FIG. 15. An acceptable weight range is provided to account for variances within the same model of cartridge due to the different materials that may be used based on the country of origin of the cartridge. If the refill has not been successful, the filling process may be rerun.

Alternatively, an refilling process may incorporate an automatic pneumatic needle filling mechanism. For example, a cartridge may be clipped to a pneumatic holding arm. The holding arm may then automatically move the cartridge into position to be refilled using the correct set of filling needles. For example, the holding arm may retract into a refilling unit within the housing 12 where a dispensing unit rotates to place the proper refilling needles in position for use. The holding arm may then move the cartridge towards the refilling needles such that the needles are properly inserted into the cartridge in the correct chambers and at the correct depth. A peristaltic pump then pumps the correct amount of ink into each of the chambers of the cartridge.

Figure 16:
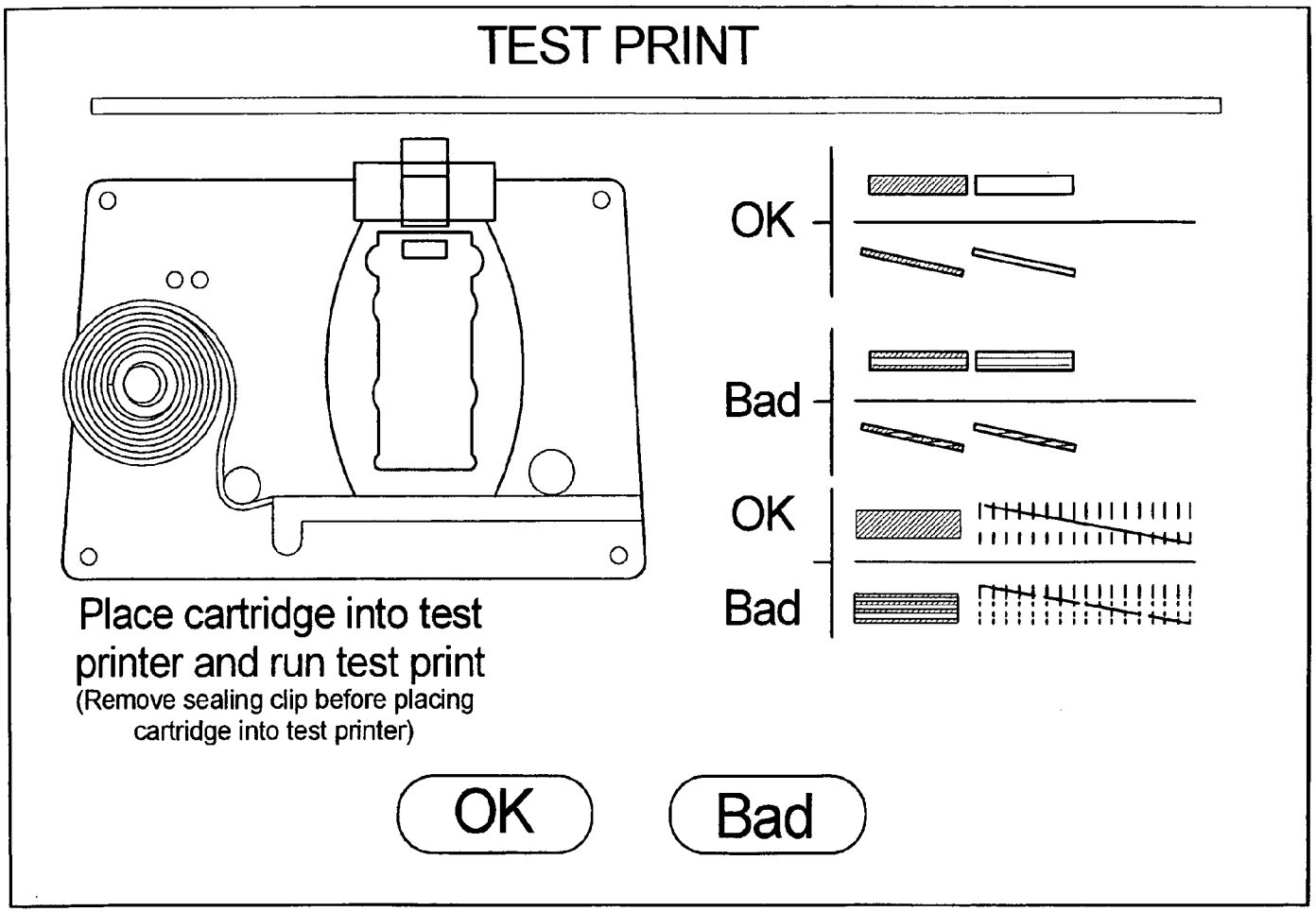
FIG. 16 is an instruction screen for the test printers which may be displayed on the video screen shown in FIG. 1.
Figure 17:
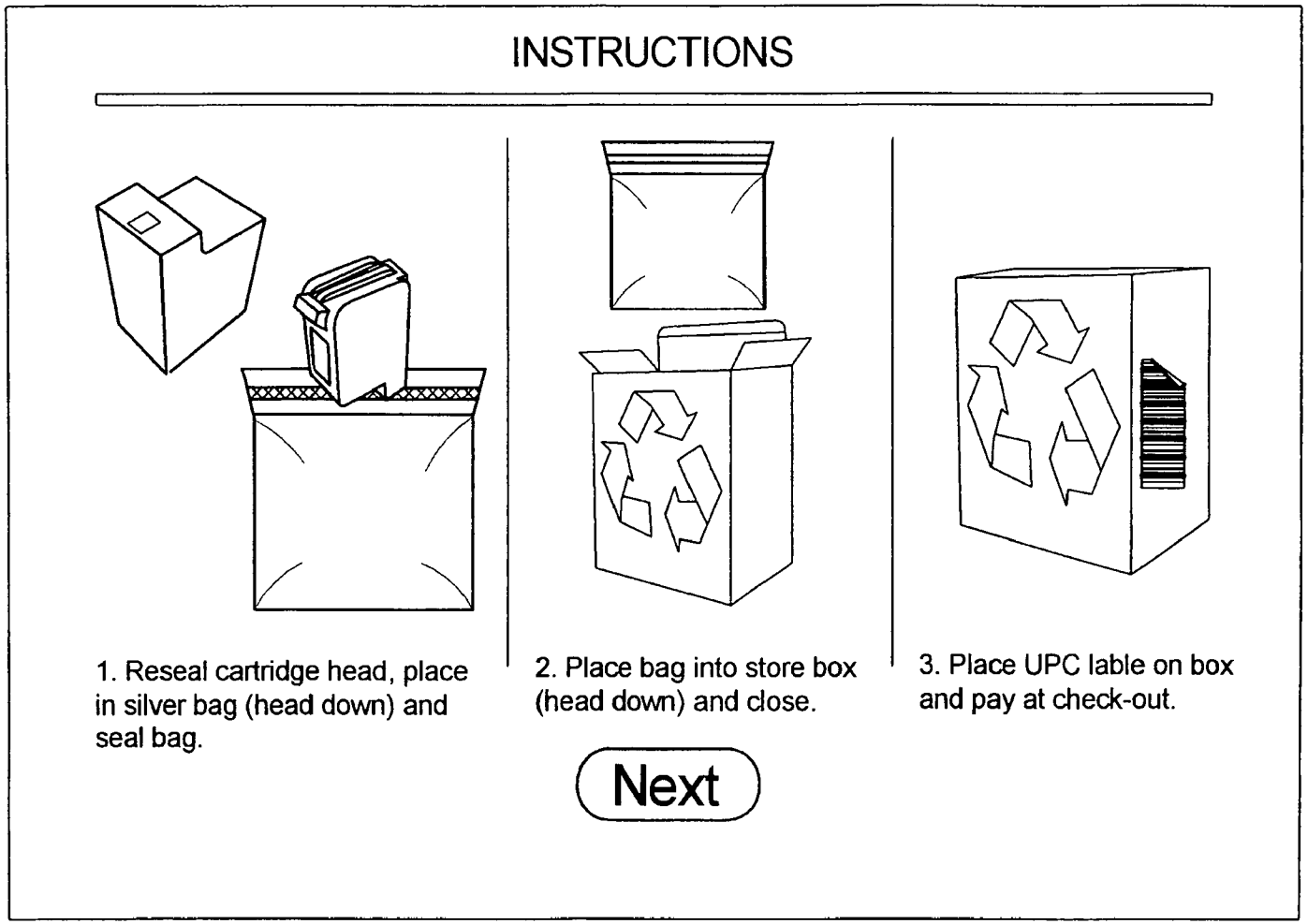
FIG. 17 is an instruction screen for completing the process which may be displayed on the video screen shown in FIG. 1.

As shown in FIG. 16, the operator is then directed to unseal the cartridge head, place the cartridge in the proper test printer 20 and run a test print to determine the print quality of the refilled cartridge. If the cartridge passes the test print, the operator is directed to reseal the cartridge head, package the cartridge and print a UPC label for purchasing the refilled cartridge, as shown in FIG. 17. If the cartridge fails the test print, the operator is directed to rerun the refilling process. The materials for resealing the cartridge's printing head and packaging the cartridge may be provided in or near the housing 12. The UPC label and sales ticket may be generated using the bar code printer 36 and the sales ticket printer 38. The sales ticket can include information such as the amount a customer must pay for having the cartridge refilled. The ticket can be brought to a cashier and/or read by a POS sales terminal. For example, the ticket may include a bar code, or other machine readable indicia, which has information relating to the sales amount. A customer can then pay for having the cartridge refilled and a receipt can be generated by the POS terminator cash register.

Figure 18:
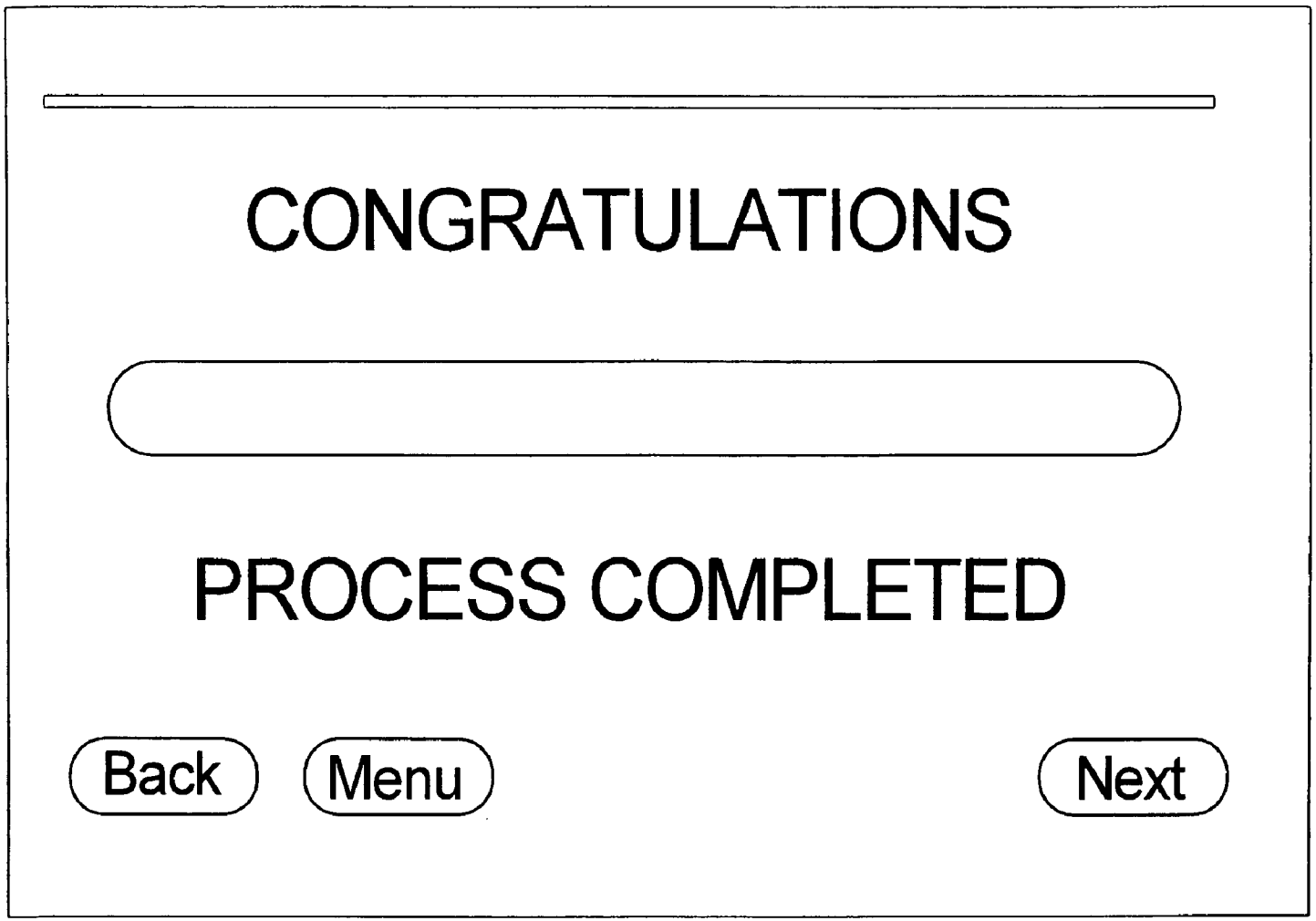
FIG. 18 is a screen signaling completion of the process which may be displayed on the video screen shown in FIG. 1.

As shown in FIG. 18, the operator may then be instructed that the process is complete.

Figure 19:
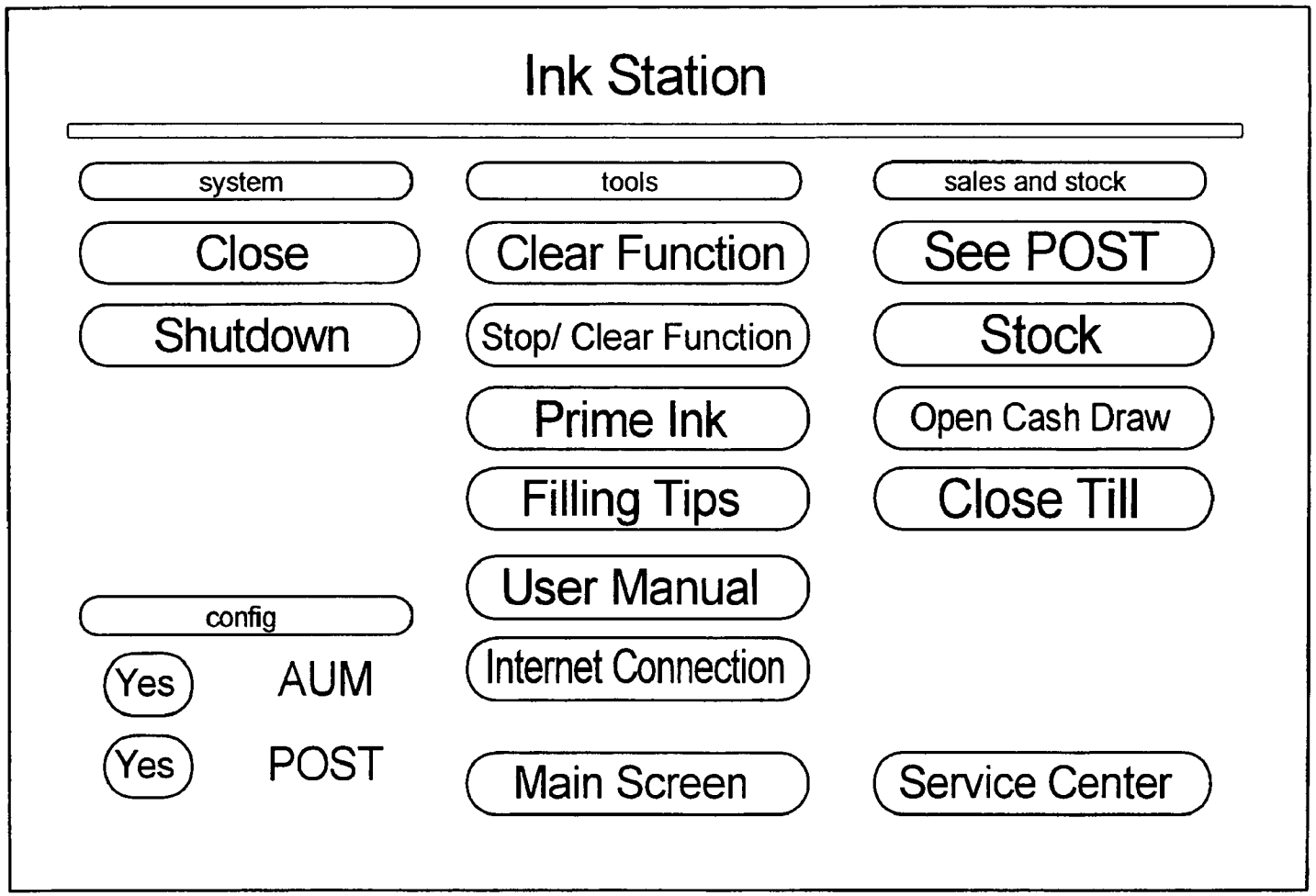
FIG. 19 is a system software screen which may be displayed on the video screen shown in FIG. 1.
Figure 20:
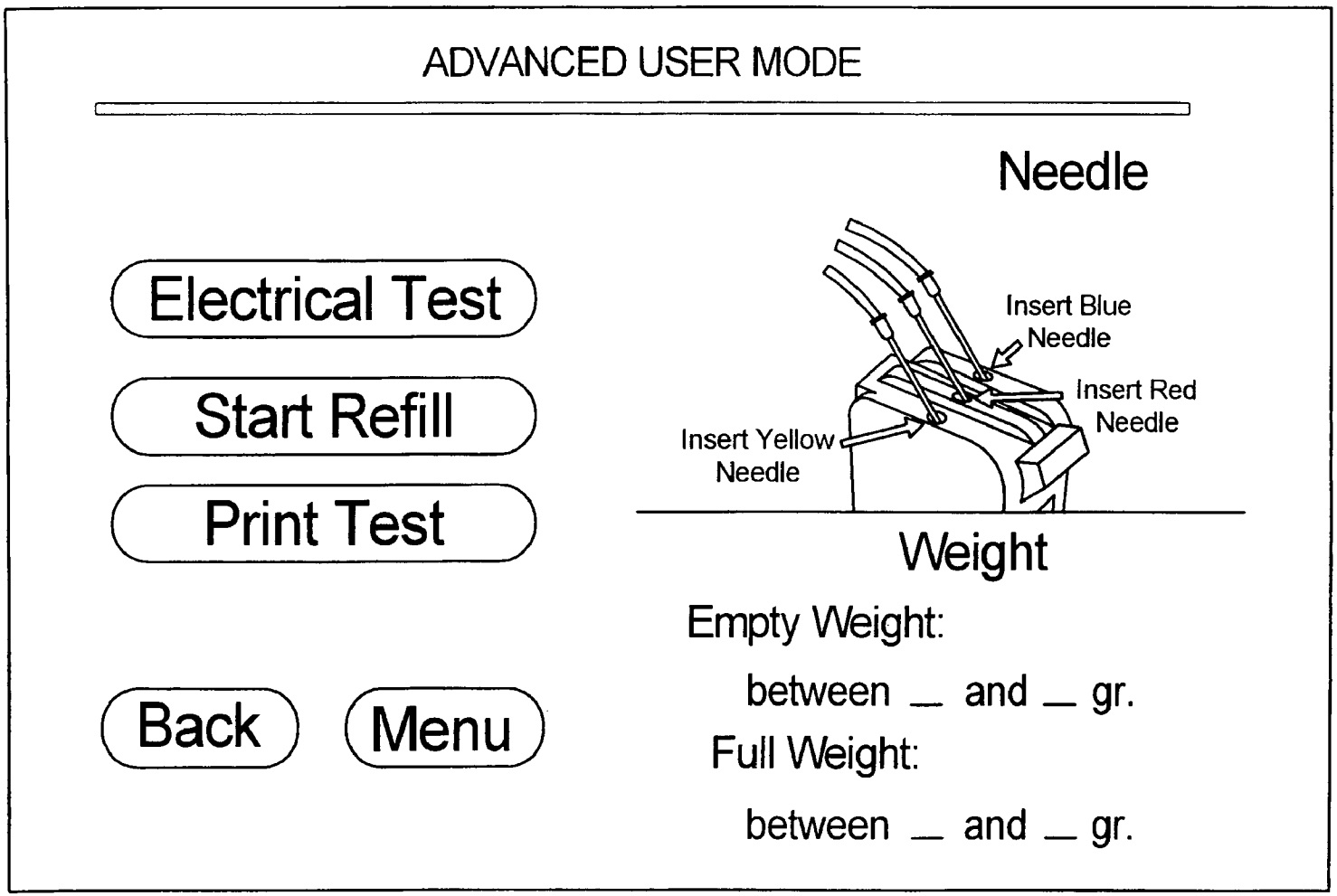
FIG. 20 is an advanced user mode instruction screen which may be displayed on the video screen shown in FIG. 1.

FIG. 19 illustrates a system menu for operating the system software. From the system menu, an operator may select various system, tools, configuration and sale and stock software. For example, as shown in FIG. 19, the system offers an advanced user mode, whereby the user is directed to electrically test the cartridge, start the refill process and test print, but the operator is not given detailed directions at each step of the processes described above. An example of an advanced user mode on-screen instruction is provided in FIG. 20.

The system 10 also includes sales control software, as shown in FIG. 19. The sales control software provides daily, weekly, monthly and yearly automatic cartridge sales and inventory reporting logs. Internet connection of the system 10 provides remote sales and inventory reporting and service diagnostics, as well as allows for online updating and upgrading of the system software.

Additionally, the system 10 may include two-way communication capabilities, such as those described in PCT Patent Application No. PCT/GB2005/004375, which was filed on Nov. 14, 2005, the entirety of which is hereby incorporated by reference. For example, the two-way communication capabilities may allow an operator to communicate with a remote terminal service agent or operator using text-based and/or voice-based communication, for example, using voice over IP communications.

As shown by the above discussion, many of the functions relating to the system 10 are implemented on a computer or computers, which of course may be connected for data communication via components of a network. The hardware of such computer platforms typically is general purpose in nature, albeit with an appropriate network connection for communication via the intranet, the Internet and/or other data networks.

As known in the data processing and communications arts, each such general-purpose computer typically comprises a central processor, an internal communication bus, various types of memory (RAM, ROM, EEPROM, cache memory, etc.), disk drives or other code and data storage systems, and one or more network interface cards or ports for communication purposes. The computer system also may be coupled to a display and one or more user input devices such as alphanumeric and other keys of a keyboard, a mouse, a trackball, the video touch screen 18, etc. The display and user input element(s) together form a service-related user interface, for interactive control of the operation of the computer system. These user interface elements may be locally coupled to the computer system, for example in a workstation configuration, or the user interface elements may be remote from the computer and communicate therewith via a network. The elements of such a general-purpose computer system also may be combined with or built into routing elements or nodes of the network.

The software functionalities involve programming of controllers, including executable code as well as associated stored data. The software code is executable by the general-purpose computer that functions as the particular computer. In operation, the executable program code and possibly the associated data are stored within the general-purpose computer platform. At other times, however, the software may be stored at other locations and/or transported for loading into the appropriate general-purpose computer system. Hence, the embodiments involve one or more software products in the form of one or more modules of code carried by at least one machine-readable medium. Execution of such code by a processor of the computer platform enables the platform to implement the system 10 functions, in essentially the manner performed in the embodiments discussed and illustrated herein.

As used herein, terms such as computer or machine readable medium refer to any medium that participates in providing instructions to a processor for execution. Such a medium may take many forms, including but not limited to, non-volatile media, volatile media, and transmission media. Non-volatile media include, for example, optical or magnetic disks, such as any of the storage devices in any computer(s). Volatile media include dynamic memory, such as main memory of such a computer platform. Physical transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include, for example: a floppy disk, a flexible disk, hard disk, magnetic tape, any other magnetic medium, a CD-ROM, DVD, any other optical medium, punch cards, paper tape, any other physical medium with patterns of holes, a RAM, a PROM, and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

Figure 21:
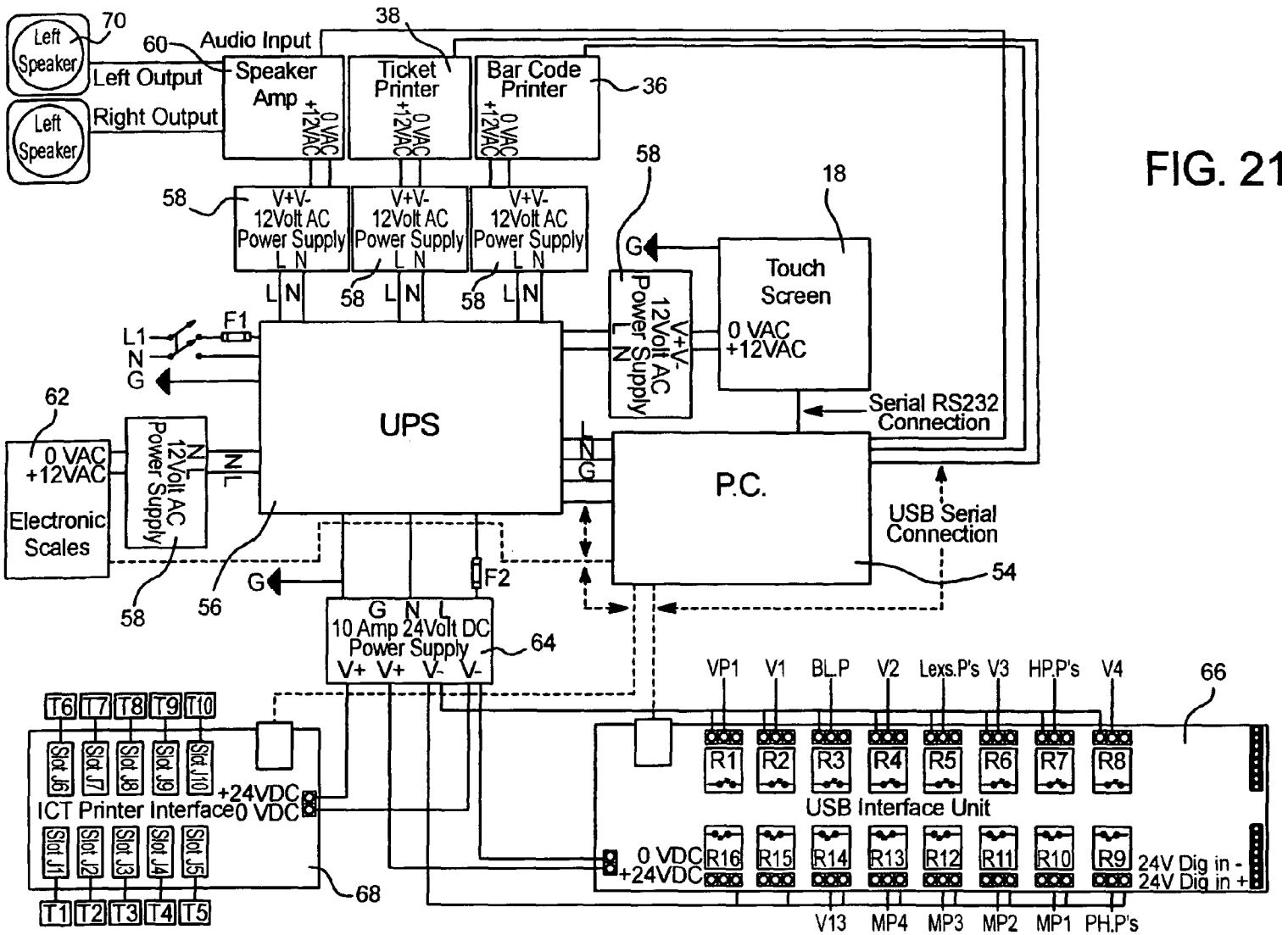
FIG. 21 is a schematic of the inkjet cartridge refilling system illustrating the main power and computer system.

FIG. 21 schematically illustrates an example of the main power and the computer systems of the inkjet cartridge refilling system 10. As shown in FIG. 21, the system 10 includes a processor/controller 54 for controlling the electronic aspects of the system 10. The processor/controller 54 is connected to a universal power supply 56, which supplies power to the electronic aspects of the system 10. The universal power supply 56 is coupled to a plurality of power supplies 58 for powering various aspects of the system 10. For example, as shown in FIG. 21, there are separate power supplies 58 for a speaker amp 60, the sales ticket printer 38, the bar code printer 36, the video touch screen 18 and the scale 62. The speaker amp 60 shown FIG. 21 is connected to pair of speakers 70, which are part of the audio system 16. The universal power supply 56 is also coupled to a separate power supply 64 for powering a USB interface unit 66 and a printer interface 68.

Additionally, the processor/controller 54 is also coupled to the speaker amp 60, the sales ticket printer 38, the bar code printer 36, the video touch screen 18, the scale 62, the USB interface unit 66 and the printer interface 68 such that each of the various components may be directly controlled by the processor/controller 54, as described above with respect to FIGS. 2-19.

The processor/controller 54 shown in FIG. 21 includes memory, which may, for example, be structured to include a database. The database may be used to store information regarding various makes and models of cartridges. For example, the database may include information regarding various cartridge weights for use with the exhausting units 22, the weighing station 24, etc. The processor/controller 54 may utilize information stored in the database to automatically control various aspects of the system 10 or to provide instructions to an operator to perform the various functions of the system 10.

Figure 22:
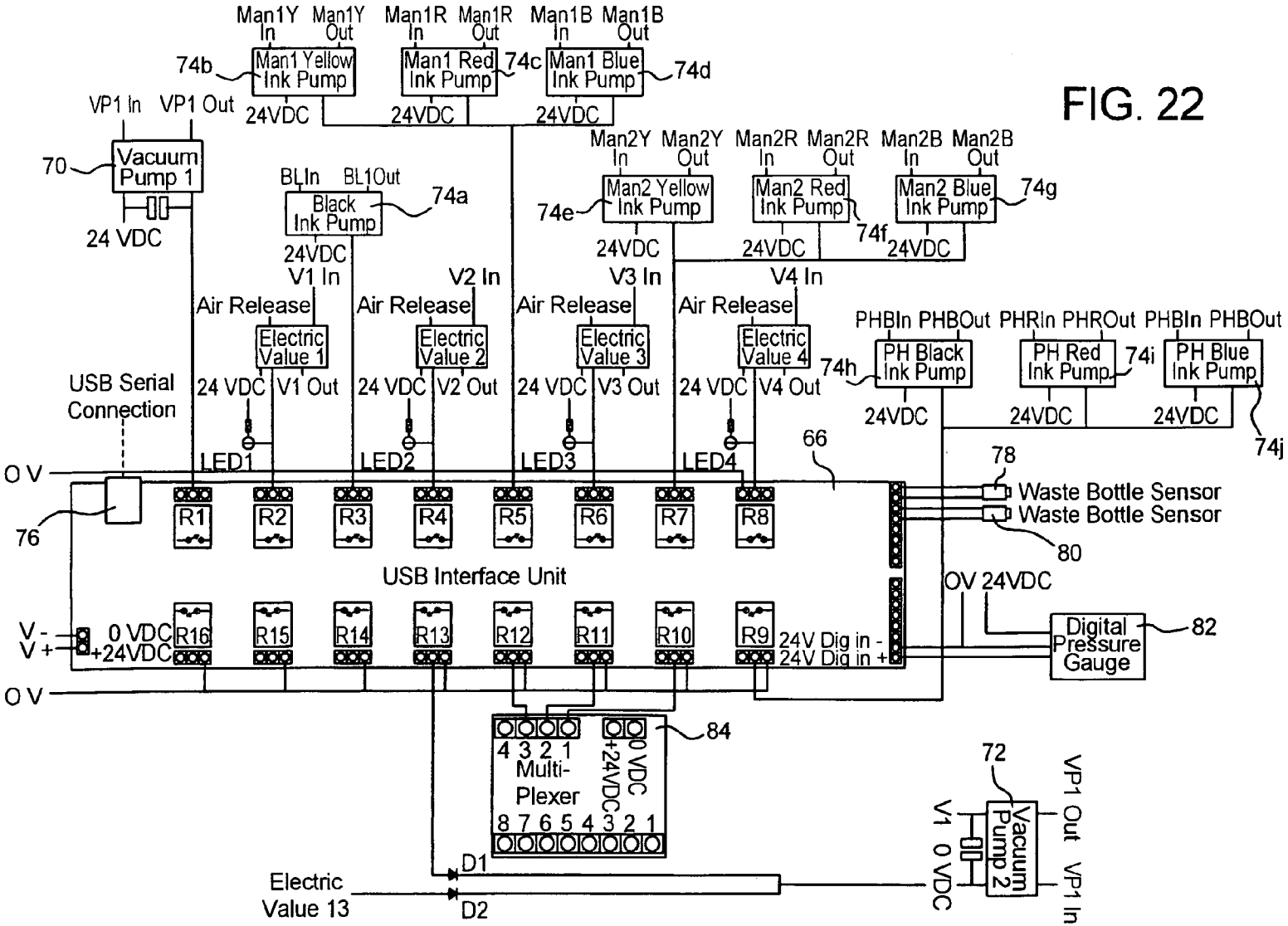
FIG. 22 is a schematic of the inkjet cartridge refilling system illustrating the USB interface and pump system.

FIG. 22 schematically illustrates an embodiment of the USB interface unit 66. The USB interface unit 66 controls a pump system, including a first vacuum pump 70, a second vacuum pump 72 and a plurality of ink pumps 74*a-j*. The USB interface unit also controls a USB serial connection 76, a waste bottle sensor 78, a water bottle sensor 80, a digital pressure gauge 82 and a first multiplexer 84. The plurality of ink pumps 74*a-j* correspond to the number of refilling needles 50 used in the refilling units 28. For example, as shown in FIG. 22, there is a first black ink pump 74*a* associated with a refilling unit for refilling black ink cartridges, a yellow ink pump 74*b*, a red ink pump 74*c* and a blue ink pump 74*d* associated with a refilling unit for refilling color cartridges from a first manufacturer, a yellow ink pump 74*e*, a red ink pump 74*f* and a blue ink pump 74*g* associated with a refilling unit for refilling color cartridges from a second manufacturer, and a black ink pump 74*h*, a red ink pump 74*i* and a blue ink pump 74*j* associated with a refilling unit for refilling color photo inkjet cartridges.

The waste bottle sensor 78 is coupled to the waste water storage 34 to provide feedback to the processor/controller 54 regarding the status of the waste water storage 34. The water bottle sensor 80 is coupled to the fresh water storage 32 to provide feedback to the processor/controller 54 regarding the status of the fresh water storage 32. For example, the waste bottle sensor 78 can inform the processor/controller 54 when the waste water storage 34 is full. Similarly, the water bottle sensor 80 can inform the processor/controller 54 when the fresh water storage 32 is empty.

Figure 23:
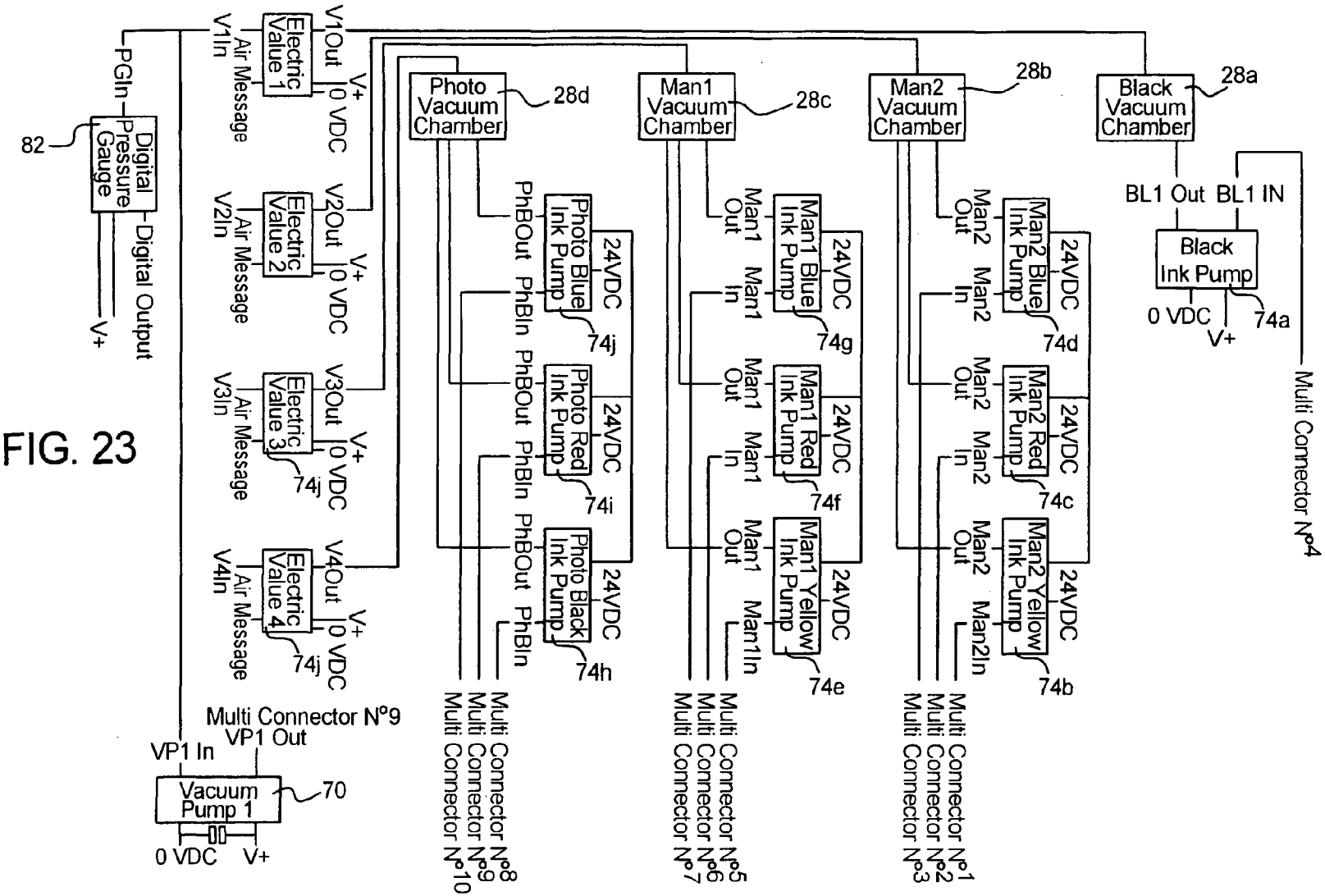
FIG. 23 is a schematic of the inkjet cartridge refilling system illustrating the refilling unit and pump system.

As shown in FIGS. 22 and 23, the digital pressure gauge 82 may be adapted to receive information from the refilling units 28 to ensure proper coordination between the refilling units 28 and the first vacuum pump 70. For example, the digital pressure gauge 82 may ensure that a 0.7 bar negative pressure vacuum is created within the refilling units 28 when refilling cartridges.

Figure 24:
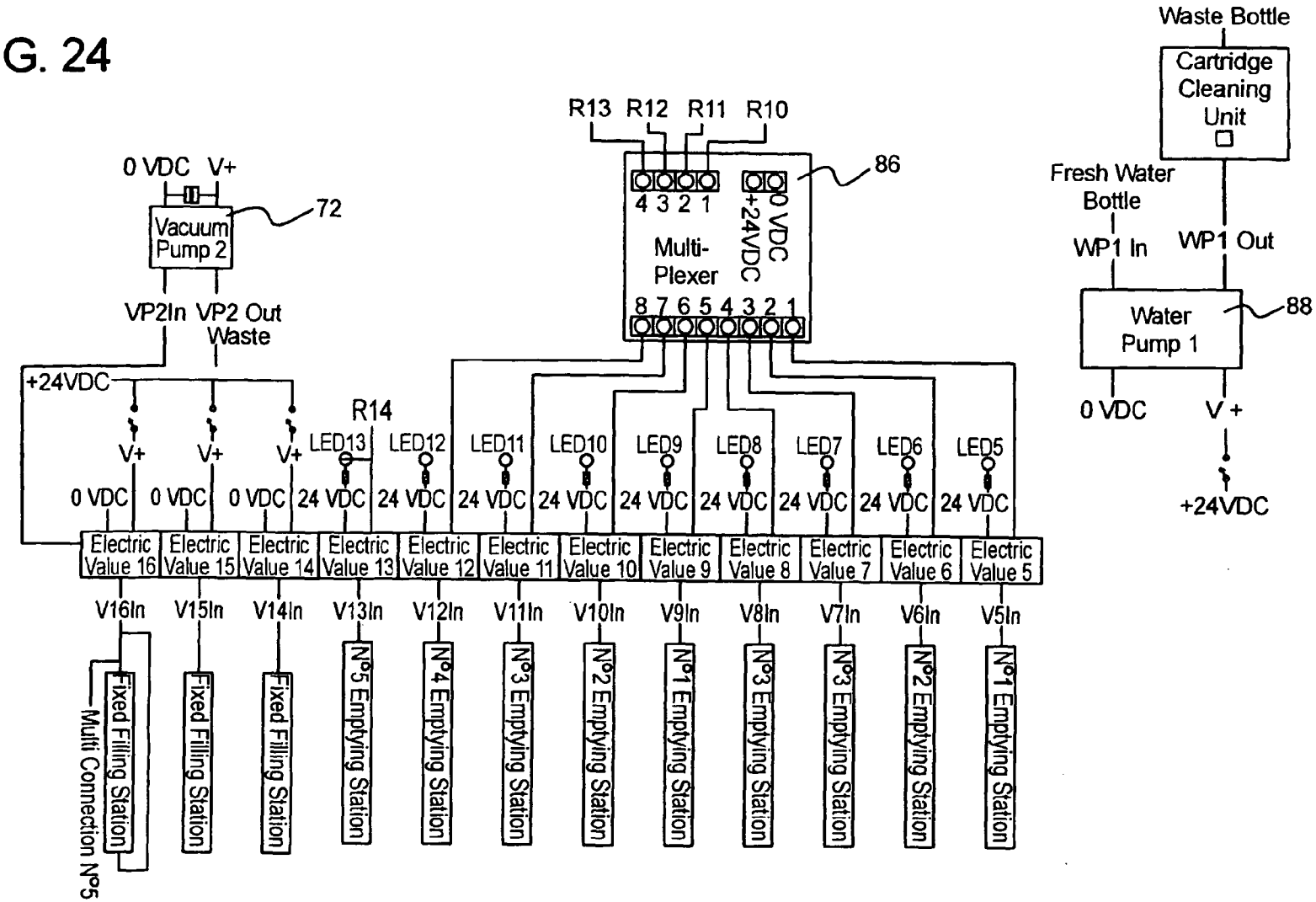
FIG. 24 is a schematic of the inkjet cartridge refilling system illustrating the electric value wiring and the atomizer.

As shown in FIG. 24, a second multiplexer 86 is coupled to the plurality of exhaust units 22 in order to combine the output from the exhaust units 22 into four outputs. As shown FIG. 22, the four outputs are received by the first multiplexer 84, which combines the signals into a single signal to be provided to the second vacuum pump 72. FIG. 24 also illustrates a water pump 88 connected to both the fresh water storage 32 and waste water storage 34.

While the foregoing has described what are considered to be the best mode and/or other examples, it is understood that various modifications may be made therein and that the technology disclosed herein may be implemented in various forms and examples, and that they may be applied in numerous applications, only some of which have been described herein. It is intended by the following claims to claim any and all modifications and variations that fall within the true scope of the advantageous concepts disclosed herein.

We claim:

1. An inkjet cartridge refilling system comprising:

a housing; and a plurality of refilling units located on said housing wherein each refilling unit is adapted to refill an inkjet cartridge under at least partial vacuum;

an electronic scale located on said housing for weighing the inkjet cartridge and determining a measured weight of the cartridge; and a controller coupled to the refilling units and to the electronic scale, the controller having a memory containing stored information regarding an acceptable weight range for a refilled inkjet cartridge;

whereby the scale has circuitry for receiving the weight range information from the controller and comparing the cartridge's measured weight with the weight range information, and communicating the results of the comparison to the controller.

2. The inkjet cartridge refilling system of claim 1 wherein said plurality of refilling units includes at least one refilling unit configured for refilling black ink cartridges, at least one refilling unit configured for refilling color ink cartridges and at least one refilling unit configured for refilling photo ink cartridges.

3. The inkjet cartridge refilling system of claim 1 wherein said plurality of refilling units operate to refill cartridges under at least partial vacuum.

4. The inkjet cartridge refilling system of claim 1 further comprising a network connection for transmitting and receiving information through a computer network.

5. The inkjet cartridge refilling system of claim 4 wherein said information corresponds to sales and inventory reporting.

6. The inkjet cartridge refilling system of claim 1 further comprising a network connection for sending and receiving data packets relating to audio information.

7. The inkjet cartridge refilling system of claim 1 wherein said controller controls the refilling of a cartridge based on the results of the comparison received from the electronic scale.

8. The inkjet refilling system of claim 1 further comprising a ticket generator for generating a sales ticket for the inkjet cartridges, wherein the sales ticket includes information relating to a sales amount.

* * * * *